US011369162B2

(12) United States Patent
Chan et al.

(10) Patent No.: US 11,369,162 B2
(45) Date of Patent: Jun. 28, 2022

(54) CLOSURE MECHANISMS FOR ARTICLES OF FOOTWEAR AND APPAREL

(71) Applicant: NIKE, Inc., Beaverton, OR (US)

(72) Inventors: Wesley K. Chan, Portland, OR (US); Ryan J. Maddox, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 93 days.

(21) Appl. No.: 16/455,314

(22) Filed: Jun. 27, 2019

(65) Prior Publication Data

US 2020/0008516 A1 Jan. 9, 2020

Related U.S. Application Data

(60) Provisional application No. 62/694,878, filed on Jul. 6, 2018.

(51) Int. Cl.
*A43B 3/26* (2006.01)
*A43B 11/00* (2006.01)
(Continued)

(52) U.S. Cl.
CPC ..... *A43B 3/26* (2013.01); *A43B 11/00* (2013.01); *A43B 23/0295* (2013.01); *A44B 11/2592* (2013.01)

(58) Field of Classification Search
CPC ..... A43B 3/26; A43B 11/00; A43C 11/1406; A43C 11/24; A44B 11/2592
(Continued)

(56) References Cited

U.S. PATENT DOCUMENTS 3,862,773 A 1/1975 Bisbing
4,120,103 A * 10/1978 Colby ..... A43B 3/26 36/130
(Continued)

FOREIGN PATENT DOCUMENTS

CA 2 386 645 A1 11/2003
CN 101312670 A 11/2008
WO WO 2007/056791 A1 5/2007

OTHER PUBLICATIONS

International Search Report and Written Opinion mailed in related International Application No. PCT/US2019/039560, dated Sep. 13, 2019, 13 pages.
(Continued)

*Primary Examiner* — Sharon M Prange
(74) *Attorney, Agent, or Firm* — Klarquist Sparkman, LLP

(57) ABSTRACT

An article of footwear includes an upper and a closure mechanism. The upper has an opening at least partially located between a first and second portions of the upper. The opening is adjustable between open and closed configurations. The closure mechanism is moveable between unlocked and locked positions and includes a locking element coupled to the first portion of the upper and a projection coupled to the second portion of the upper. The projection is moveable in a first direction relative to the locking element to engage with the locking element, thereby moving the closure mechanism to the locked position and moving the upper to the closed configuration. The projection is moveable in the first direction relative to the locking element to disengage with the locking element, thereby moving the closure mechanism to the unlocked position and allowing the upper to return to the open configuration.

20 Claims, 15 Drawing Sheets

(51) Int. Cl.
*A44B 11/25* (2006.01)
*A43B 23/02* (2006.01)

(58) Field of Classification Search
USPC ..... 24/68 E, 321
See application file for complete search history.

(56) References Cited

U.S. PATENT DOCUMENTS 5,815,843 A 10/1998 Brillhart, III et al.
6,189,239 B1 * 2/2001 Gasparovic ..... A43B 3/30 36/102
7,685,747 B1 * 3/2010 Gasparovic ..... A43C 11/002 36/102
7,793,438 B1 * 9/2010 Busse ..... A43B 11/02 36/105
7,900,757 B2 3/2011 Sisitsky
9,414,640 B2 * 8/2016 Nichols ..... A43B 5/14
9,516,920 B1 * 12/2016 DeRose ..... A43B 3/26
10,602,797 B2 * 3/2020 Lintaman ..... A43C 1/00
2002/0095823 A1 * 7/2002 Laio ..... A43B 3/24 36/138
2007/0234523 A1 10/2007 Laks
2008/0263896 A1 10/2008 Karandonis et al.
2009/0241306 A1 * 10/2009 Pontaoe ..... A44B 11/2534 24/614
2012/0023783 A1 2/2012 Nichols
2017/0196312 A1 7/2017 Xanthos

OTHER PUBLICATIONS

First Office Action dated Jul. 23, 2021, issued by China National Intellectual Property Administration, Patent Application No. 201980045592.X, in Chinese, 96 pages.

* cited by examiner

CLOSURE MECHANISMS FOR ARTICLES OF FOOTWEAR AND APPAREL

CROSS REFERENCE TO RELATED APPLICATIONS

This application claims the benefit of U.S. Provisional Patent Application No. 62/694,878, filed Jul. 6, 2018, which is incorporated by reference herein.

FIELD

This disclosure relates generally to closure mechanisms and more particularly to closure mechanisms for articles of footwear and/or apparel.

BACKGROUND

Articles of footwear and/or apparel (collectively or individually referred to herein as "articles") frequently have closure mechanisms attached thereto. Such article can be opened/loosened and closed/tightened to allow an object to be inserted into the article. The closure mechanism can be used to secure the article in the closed/tightened configuration. Some examples of conventional closure mechanisms include laces, straps, zippers, buckles, etc.

DETAILED DESCRIPTION

General Considerations

Figure 1A:
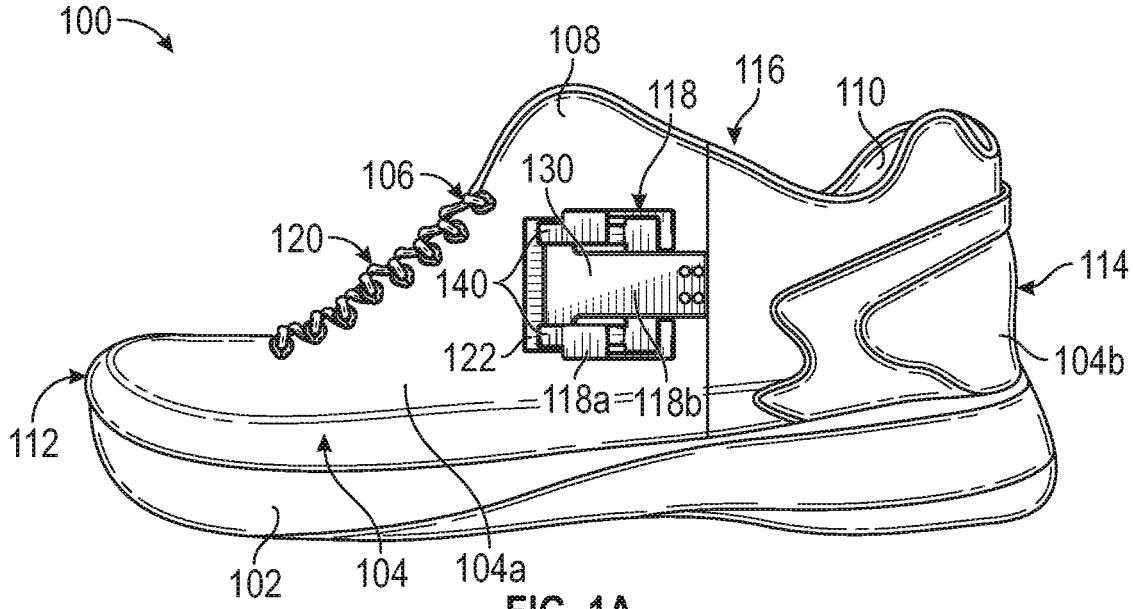
FIG. 1A depicts a side elevation view an article of footwear having an exemplary closure mechanism that includes a clasp, which is shown in a locked configuration.

For purposes of this description, certain aspects, advantages, and novel features of the embodiments of this disclosure are described herein. The described methods, systems, and apparatus should not be construed as limiting in any way. Features, characteristics, and/or groups described in conjunction with a particular aspect, embodiment or example are to be understood to be applicable to any other aspect, embodiment or example described herein unless incompatible therewith. All of the features disclosed in this specification (including any accompanying claims, abstract, and drawings), and/or all of the steps of any method or process so disclosed, may be combined in any combination, except combinations where at least some of such features and/or steps are mutually exclusive. The disclosure is not restricted to the details of any foregoing embodiments. The disclosure extends to any novel one, or any novel combination, of the features disclosed in this specification (including any accompanying claims, abstract, and drawings), or to any novel one, or any novel combination, of the steps of any method or process so disclosed.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods, systems, and apparatus can be used in conjunction with other systems, methods, and apparatus.

The explanations of terms and abbreviations herein are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

As used herein, the term "and/or" used between the last two of a list of elements means any one of, or any combination of, the listed elements. For example, the phrase "A, B, and/or C" means "A," "B," "C," "A and B," "A and C," "B and C," or "A, B, and C."

As used herein, the terms "attached" and "coupled" generally mean physically connected or linked, which includes items that are directly attached/coupled and items that are attached/coupled with intermediate elements between the attached/coupled items, unless specifically stated to the contrary.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, claims, abstract, and drawings.

Introduction to the Disclosed Technology

Articles of footwear and/or apparel frequently have a closure mechanism attached thereto. For example, articles of footwear can include running shoes, soccer shoes, football shoes, rugby shoes, basketball shoes, baseball shoes, sneakers, hiking boots, sandals, socks, and other types of footwear. Articles of apparel can, for example, include bags, hats, gloves, jackets, vests, shorts, pants, as well as other wearable and non-wearable softgoods.

Conventional closure mechanisms, such as laces, straps, zipper, and buckles, can be difficult to open, close, and/or adjust. These problems are particularly pronounced for young children and/or persons with physical or mental challenges or disabilities. For example, young children often struggle to tie their shoe laces. As another example, persons who have limited dexterity in the fingers or hands (e.g., due to arthritis, injury, amputation, etc.) often cannot open or close conventional closure mechanisms which require multiple types of motion (e.g., pushing/pulling, grasping/tying, etc.).

Conventional closure systems can also be time consuming to open, close, and/or adjust. This can be particularly problematic for individuals that are required to dress quickly, such as emergency responders (e.g., firefighters).

The closure mechanisms disclosed herein overcome the shortcomings of typical closure mechanisms and by being relatively easy and quick to open, close, and/or adjust, even for people with limited physical and/or mental capabilities.

The disclosed closure mechanisms can be moved between unlocked and locked positions by moving one component in a first direction relative to another component. These single-direction closure mechanisms are therefore significantly easier to actuate than conventional closure mechanisms.

The disclosed closure mechanisms can also be particularly advantageous, for example, when they are coupled to a portion of an article that subject to tensile forces, though the closure mechanisms are also suitable for other loads and/or forces (e.g., compressive, shear, etc.). For example, the closure mechanisms are particularly suitable for securing the openings of footwear and apparel, for the straps of bags or backpacks, and/or other items that are ordinarily subject to tensile forces.

The foregoing and other objects, features, and/or advantages of the disclosed technology will become more apparent from the following description, which proceeds with reference to the accompanying figures, as well as the claims and accompanying drawings.

Exemplary Embodiments

Described below are some exemplary embodiments of closure mechanisms can be moved between unlocked and locked positions by moving one component in a first direction relative to another component.

FIGS. 1A-10 show an exemplary article of footwear 100 and a closure mechanism that can be moved between unlocked and locked positions by moving one component in a first direction relative to another component. Referring to FIG. 1A, the article 100 can include a sole structure 102, an upper 104, and a tongue 106. The upper 104 can be coupled to the sole structure 102, and the tongue 106 can be coupled to or integrally formed with the upper 104. The article 100 can also have a lateral side portion 108 and a medial side portion 110. The lateral and medial side portions 108, 110 can be defined by a plane that extends from a toe portion 112 of the article 100 to a heel portion 114 of the article, bisecting the widest part of the sole structure 102, and that extends in a superior/inferior direction (e.g., vertical in the orientation shown in FIG. 1A).

The sole structure 102 can be formed of one or more materials, including natural and synthetic rubber, polymers, foams, natural or synthetic leather, or any combination of these materials. In some embodiments, the sole structure can be a single component, as shown in the illustrated embodiment. In other embodiments, the sole structure can include a plurality of portions that can be coupled together (e.g., with a closure mechanism).

Figure 1B:
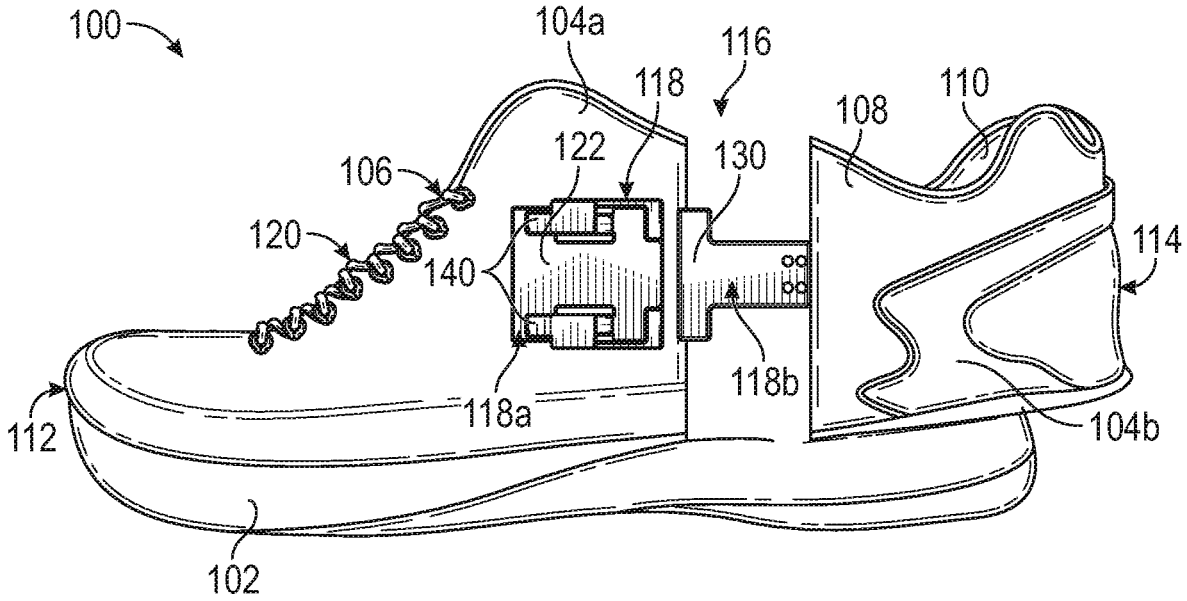
FIG. 1B depicts a side elevation view of the article of footwear of FIG. 1A, showing the clasp of the closure mechanism in an unlocked configuration.

As shown in FIGS. 1A-1B, the upper 104 can comprise a first or front portion 104*a* and a second or back portion 104*b*. In some embodiments, the front portion 104*a* of the upper can be fixedly secured relative to the sole structure 102, and the back portion 104*b* of the upper can be movably coupled to the front portion 104*a* of the upper and to the sole structure 102, as further described below.

The upper 104 can be formed of one or more materials, including a textile, a natural fabric, a synthetic fabric, a knit, a woven material, a nonwoven material, a mesh, a leather, a synthetic leather, a polymer, a rubber, and a foam, or any combination of these materials. In some embodiments, the upper 104 can be a printed structure formed by three-dimensional printing.

The article 100 can also have an opening 116 into which a wearer's foot can be inserted and secured within. The article 100 can further comprise one or more closure mechanisms for adjusting the size of the opening 116. Each of the closure mechanisms can be adjusted between an open or unsecured configuration, which expands the opening 116 and makes it relatively easy for the wearer to insert their foot into or remove their foot from the opening 116, and a closed or secured configuration, which constricts the opening 116 and makes it relatively difficult for the wearer to insert their foot into or remove their foot from the opening 116.

For example, the article 100 can have one or more first closure mechanisms (e.g., clasps 118) and one or more optional second closure mechanisms (e.g., a lace 120, straps, etc.). In the illustrated embodiment, the article 100 has two clasps 118 (e.g., one clasp 118 on the lateral side of the upper 104 and another clasp 118 on the medial side of the upper (not shown)) and the lace 120 disposed over the tongue 106. In other embodiments, the article 100 can omit the second closure mechanism or have a different type of second closure mechanism (e.g., adjustable straps). In some embodiments, the article 100 can have less or more than two clasps 120 (e.g., 1 or 3-6 clasps). For example, the article 100 can have one clasp 118 on the lateral side of the upper 104 and no other clasps. In other embodiments, the article 100 can, for example, have a plurality of clasps 118 on the lateral side of the upper 104 and a plurality of clasps 118 on the medial side of the upper.

Since the clasps 118 on the medial and lateral sides 108, 110 of the article 100 have the same general structure, this description refers only to one clasp 118 for simplicity. It should be understood that the description of one clasp applies to medial and lateral clasps, unless stated otherwise. In other embodiments, a clasp disposed one side of an article can be configured differently than a clasp disposed on a second side of the article.

Referring to FIG. 1B, the clasp 118 has a first or female component 118*a* coupled to the front portion 104*a* of the upper 104 and a second or male component (which is also referred to herein as a projection) 118*b* coupled to the back portion 104*b* of the upper 104. In other embodiments, the female component 118*a* can be coupled to the back portion 104*b* of the upper, and the male component 118*b* can be coupled to the front portion 104*a* of the upper.

The clasp 118 can be unlocked or opened, which allows the female and male components 118*a*, 118*b* of the clasp to move relative to each other. As shown in FIG. 1B, this allows the back portion 104*b* of the upper to move relative to the front portion 104*a* of the upper and therefore allows the opening 116 of the article 100 to be expanded. The clasp 118 can also be locked or closed, which restricts relative movement between the female and male components 118*a*, 118*b* of the clasp. As shown in FIG. 1A, the clasp 118 prevents or restricts movement between the front and back portions 104*a*, 104*b* of the upper and therefore constricts the opening 116 of the article 100 and prevents the opening 116 from expanding.

Figure 2:
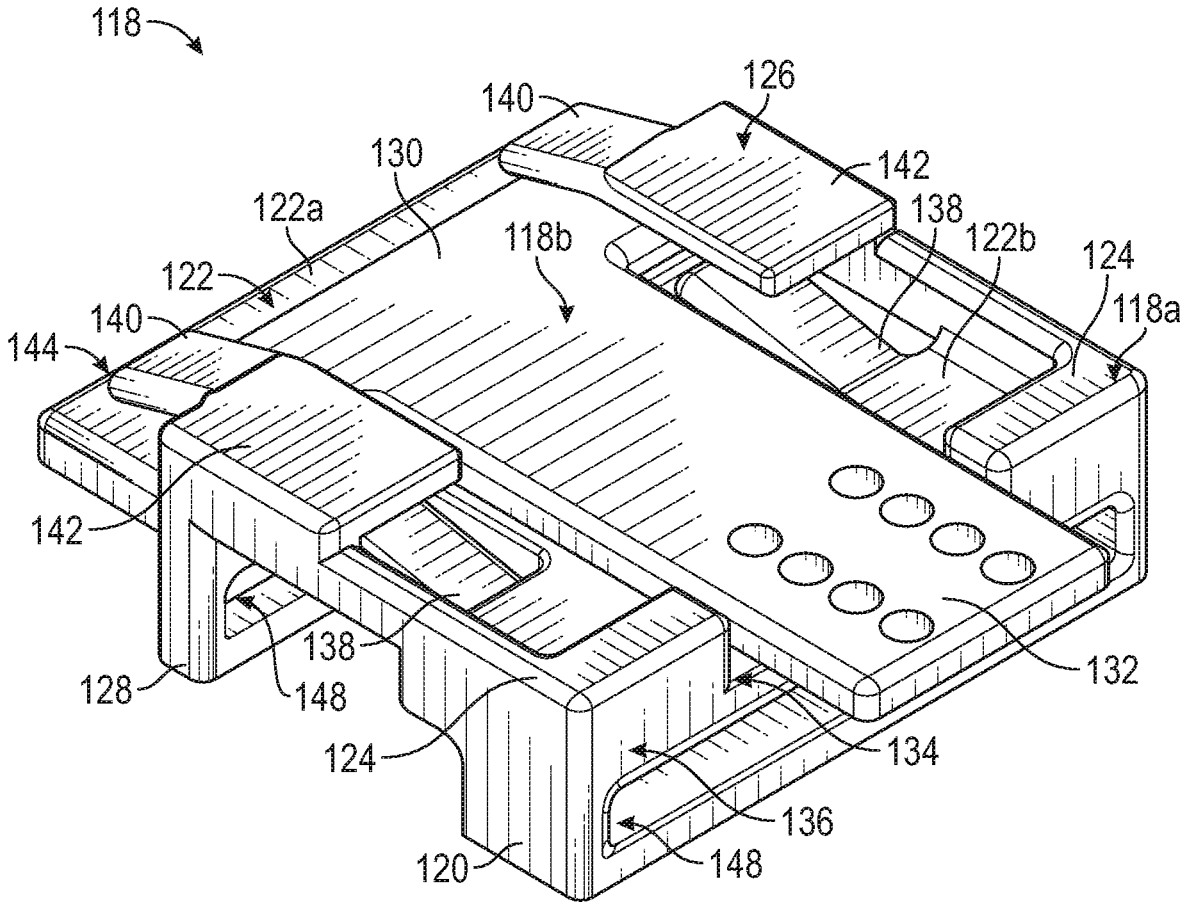
FIG. 2 depicts a perspective view of the clasp of the article of footwear of FIG. 1A.
Figure 3:
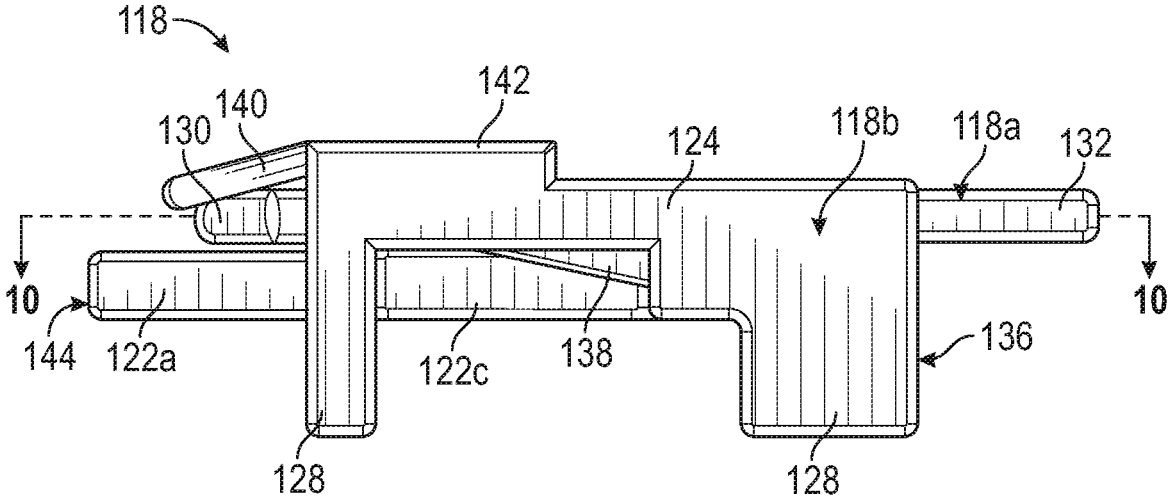
FIG. 3 depicts an elevation view of a first side of the clasp of the article of footwear of FIG. 1A.
Figure 4:
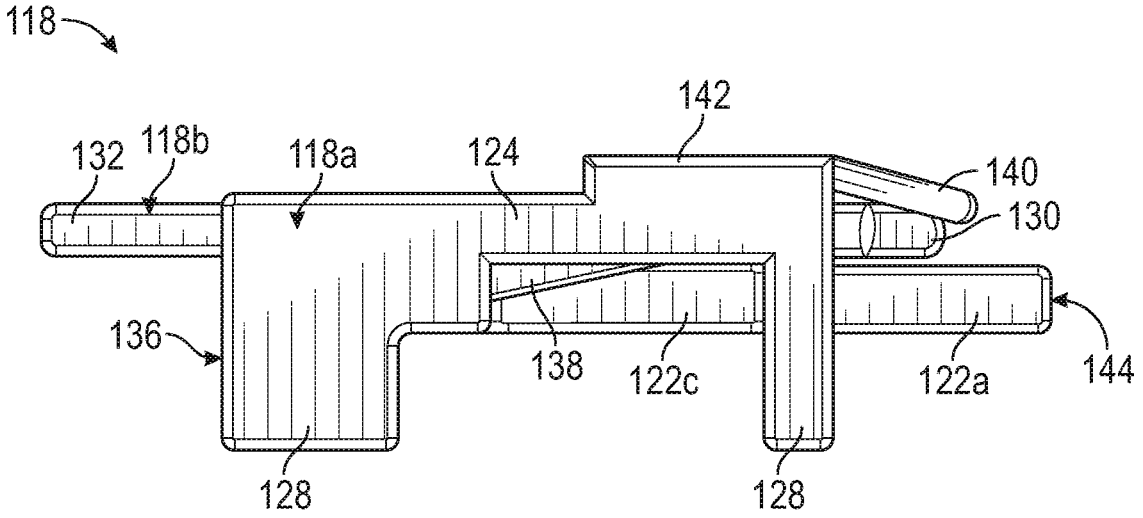
FIG. 4 depicts an elevation view of a second side of the clasp of the article of footwear of FIG. 1A.

Referring to FIG. 2, the female component 118*a* of the clasp 118 comprises a main platform 122, a plurality of guide rails 124, a locking element 126, and an attachment element 128. The main platform 122 can be configured for supporting the male component 118*b*. The guide rails 124 can extend at least partially around a perimeter of the main platform 122 and can be configured for guiding the male component 118*b* along the main platform 122 as the male component 118*b* moves relative to the female component 118*a*. The locking element 126 can be coupled to and extend from the main platform 122 and can be configured to retain the position of the male component 118*b* relative to the female component 118*a*. The attachment element 128 can be coupled to and extend from the main platform 122 and can be configured for attaching the female component 118*a* to the article 100.

Figure 10:
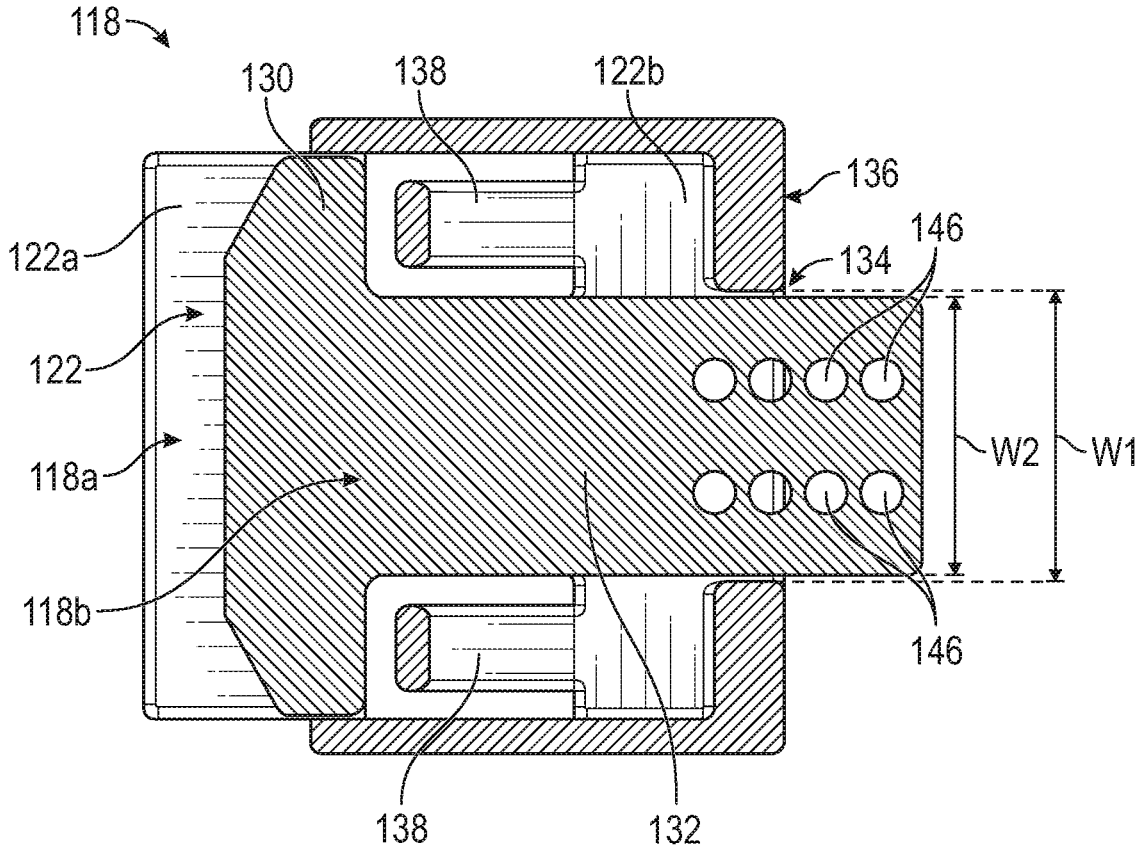
FIG. 10 depicts a cross-sectional view of the clasp of the article of footwear of FIG. 1A, which is taken from the perspective of line 10-10 of FIG. 3.

Referring to FIG. 10, the male component 118*b* can be generally "T-shaped" or "spade-shaped" with a head portion 130 and an elongate stem portion 132 coupled to and extending from the head portion 130. The stem portion 132 can have one or more attachment elements configured for attaching the stem to a portion of an article. For example, in the illustrated embodiment, the stem portion 132 includes a plurality of openings 146 (e.g., eight in the illustrated embodiment). The openings 146 can be used to secure the male component 118*b* to the second portion 104*b* of the upper 104 with fasteners that extend through the openings 146. Exemplary fasteners include, stitching, rivets, bolts, and/or other means for fastening. Additionally or alternatively, the male component 118*b* can be coupled to the article 100 with an adhesive and/or other means for coupling.

Figure 5:
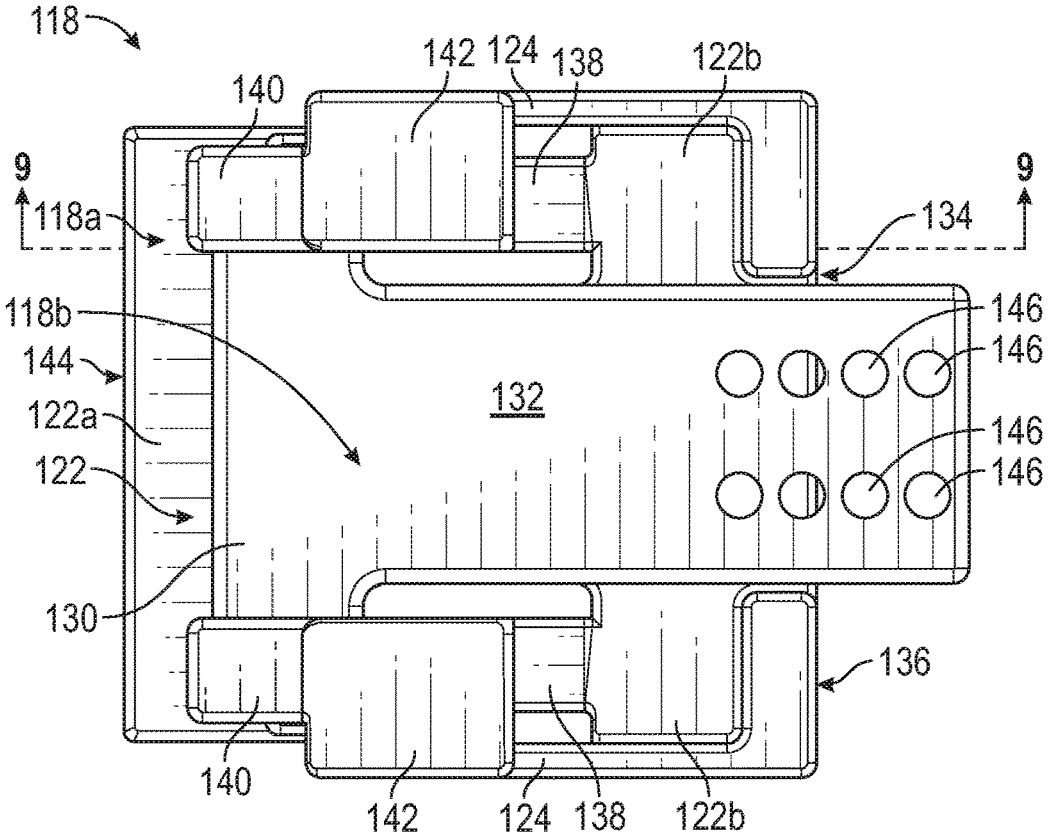
FIG. 5 depicts a top plan view of the clasp of the article of footwear of FIG. 1A.
Figure 6:
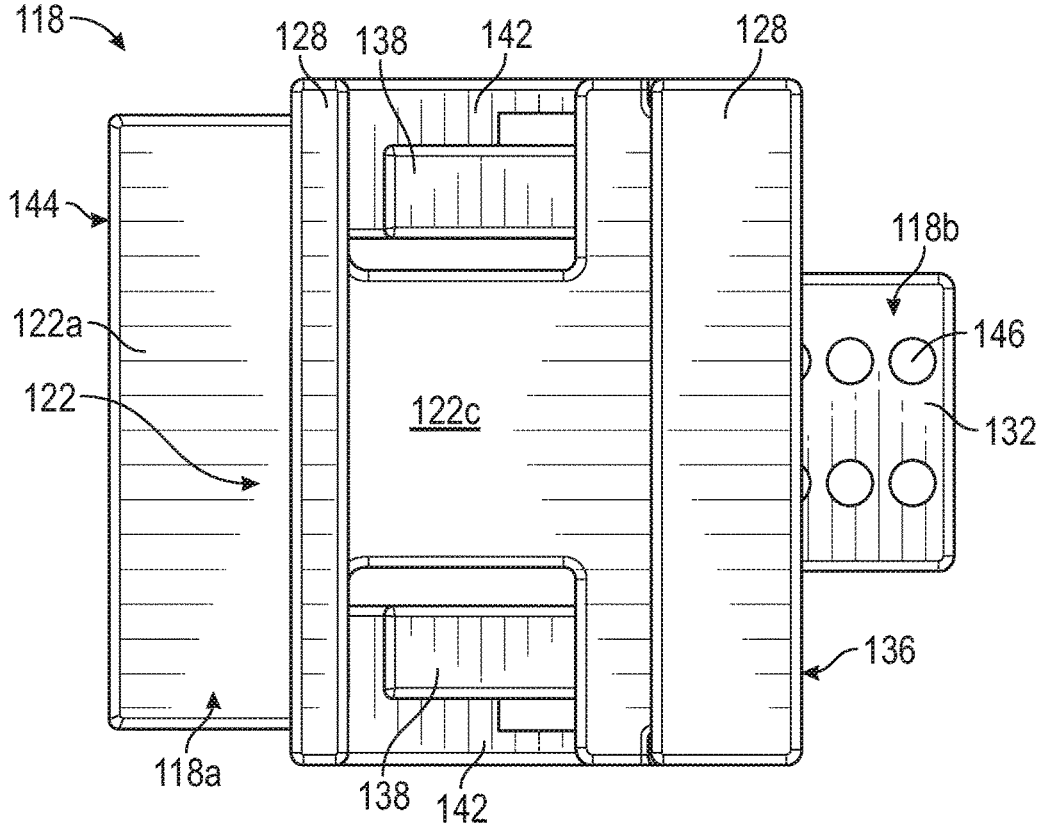
FIG. 6 depicts a bottom plan view of the clasp of the article of footwear of FIG. 1A.
Figure 7:
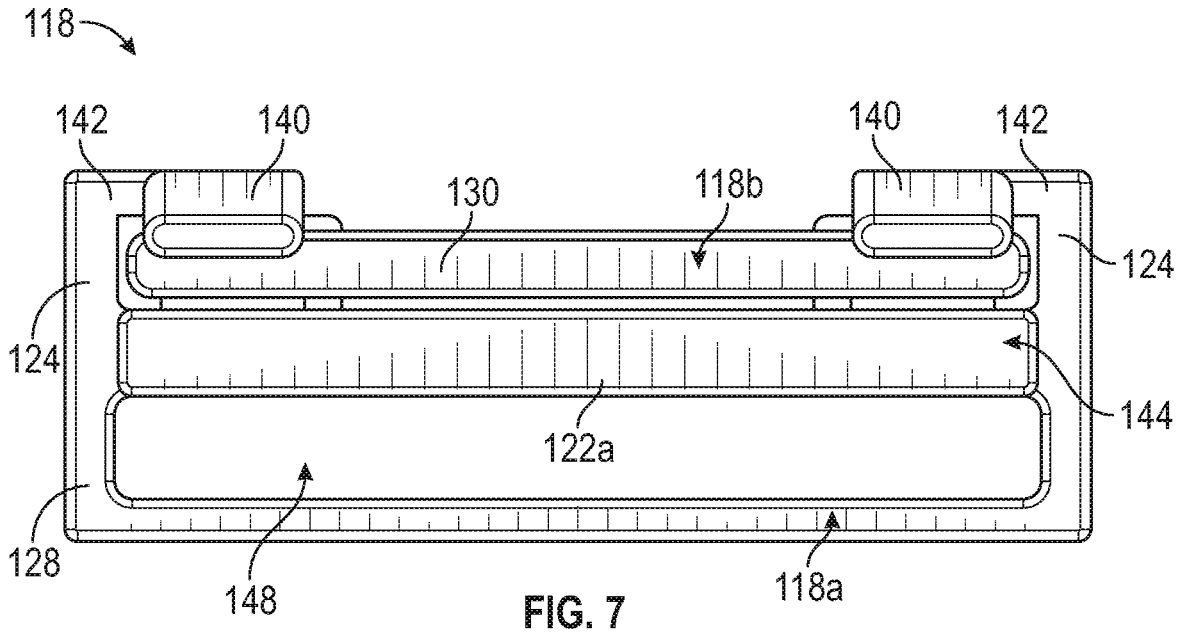
FIG. 7 depicts an elevation view of a first end of the clasp of the article of footwear of FIG. 1A.

As shown in FIGS. 5-6, the main platform 122 can, in some embodiments, be generally "I-shaped," with first and second portions 122*a*, 122*b* that extend laterally and a third portion 122*c* that extends longitudinally between the first and second portions 122*a*, 122*b*. The portions 122*a*, 122*b*, 122*c* are collectively and/or generically referred to herein as the "main platform 122." In other embodiments, the main platform 122 can have various other shapes, including rectangular.

Figure 8:
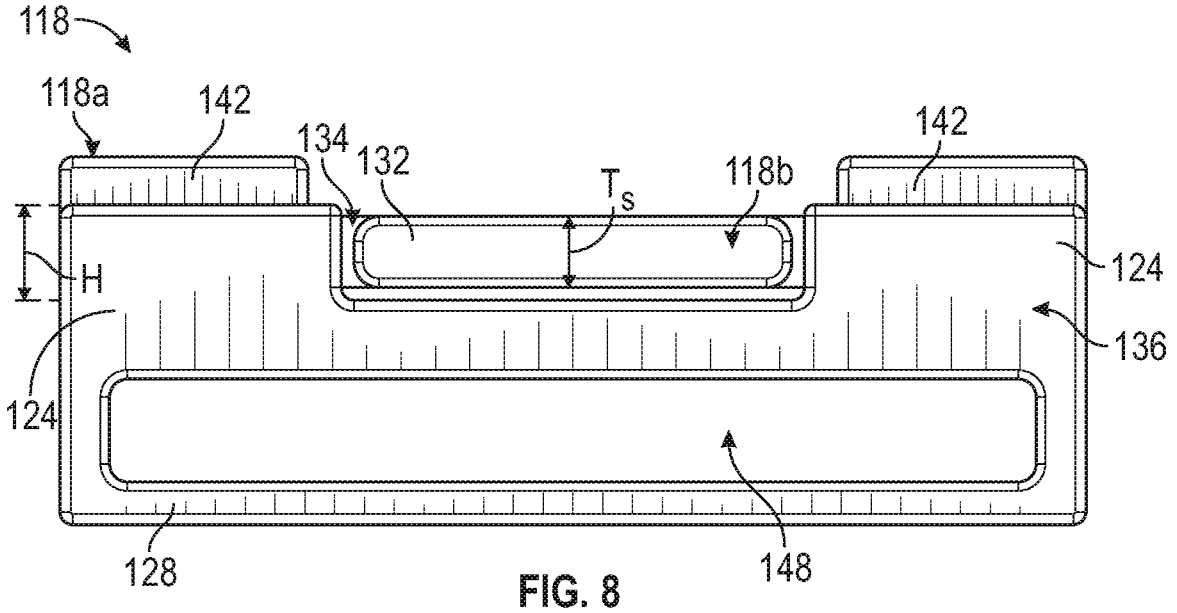
FIG. 8 depicts an elevation view of a second end of the clasp of the article of footwear of FIG. 1A.

As shown in FIG. 8, the guide rails 124 of the female component 118*a* can extend above the main platform 122 by a height H. The height H of the guide rails 124 can be configured such that the guide rails 124 act as a guide or track along which the male component 118*b* can slide, as further described below.

The male component can have one or more thicknesses. For example, the head portion 130 of the male component 118*b* has a thickness $T_H$ (FIG. 9E), and the stem portion 132 of the male component 118*a* has a thickness $T_S$ (FIG. 8). In some embodiments, the thicknesses $T_S$ and $T_H$ of the male component 118*b* can be equal or at least substantially equal to each other. In other embodiments, the thickness $T_S$ of the male component 118*b* can be greater than the thickness $T_H$ of the male component 118*b*, or vice versa. In some embodiments, the respective thicknesses $T_H$ and $T_S$ of the head and stem portions 130, 132 can be at least substantially similar to (including slightly greater) or less than the height H (FIG. 8) of the guide rails 124 of the female component 118*a*. For example, in the illustrated embodiment, the thicknesses $T_H$ and $T_S$ of the head and stem portions 130, 132 are equal to each other (see FIG. 2) and are slightly less than height H of the guide rails 124 (see FIGS. 3 and 8). In this manner, the guide rails 124 of the female component 118*a* can act as a guide or track along which the male component 118*b* can slide.

As shown in FIGS. 8 and 10, the guide rails 124 can have a slot or notch 134 formed on a first side 136 of the female component 118*a*. Referring to FIG. 10, the notch 134 in the guide rails 124 can have a width $W_1$ that is at least slightly wider than a width $W_2$ of the stem portion 132 of the male component 118*b*. As such, the stem portion 132 of the male component 118*b* can slide through the notch 134 of the female component 118*a*.

The locking element of the female component can include one or more tabs and/or flanges that are configured to engage the male component to secure the clasp in one or more locked positions by restricting relative movement between the female and male components. For example, referring to FIG. 2, the locking element 126 of the female component 118*a* comprises a plurality of first tabs 138, a plurality of second tabs 140, and a plurality of flanges 142.

Figure 9A:
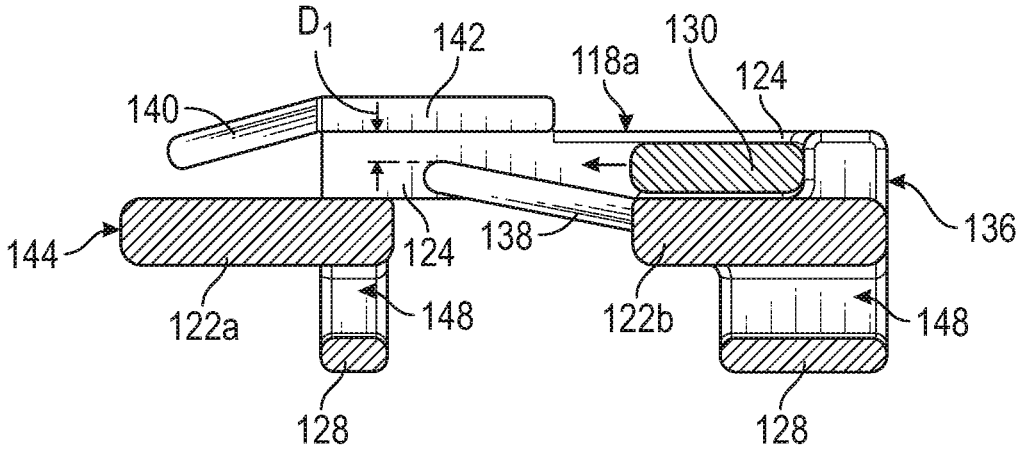
FIG. 9A depicts a cross-sectional view of the clasp of the article of footwear of FIG. 1A, which is taken from a perspective similar to that indicated by line 9-9 of FIG. 5 and shows the clasp in a first unlocked configuration.

Referring to FIG. 9A, each of the first tabs 138 of the locking element 126 can have a fixed end that is coupled to the second portion 122*b* of the main platform 122 and a free end that extends away at an angle from the second portion 122*b* of the main platform 122 toward a respective flange 142. As such, each of the first tabs 138 forms a ramp that extends from the second portion 122*b* of the main platform 122 toward an inwardly facing surface of the respective flange 142. In some embodiments, the angle between the first tabs 138 and the second portion 122*b* of the main platform 122 can be within a range of 91-179 degrees or, in certain embodiments, within a range of 135-175 degrees. In particular embodiments, the angle between the first tabs 138 and the second portion 122*b* of the main platform 122 can be within a range of 160-170 degrees.

Figure 9B:
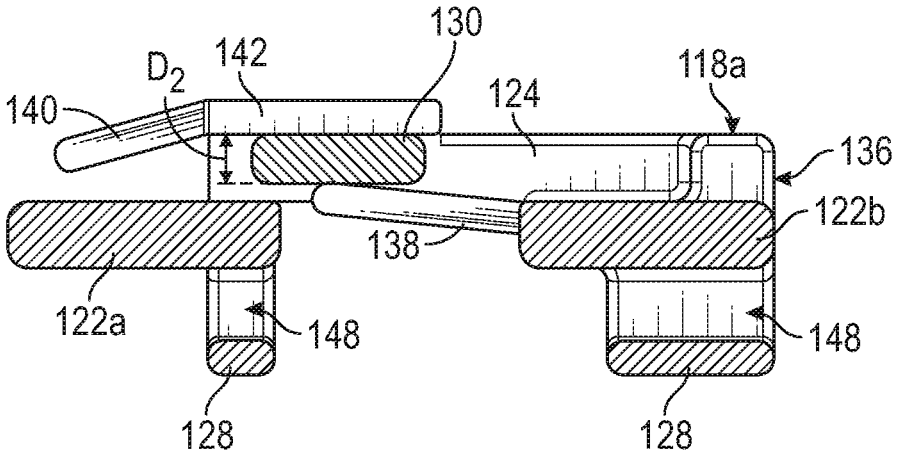
FIG. 9B depicts a cross-sectional view of the clasp of the article of footwear of FIG. 1A, which is taken from a perspective similar to that indicated by the line 9-9 of FIG. 5 and shows the clasp transitioning from the unlocked configuration to a locked configuration.

The first tabs 138 can be moved between an un-deflected state (e.g., FIG. 9A) and a deflected state (e.g., FIG. 9B). The first tabs 138 can be biased to the un-deflected state. This can be accomplished by forming the first tabs 138 from an elastically deformable material, such as metal (e.g., steel) or a polymer (e.g., acrylonitrile butadiene styrene ("ABS"), acrylonitrile styrene acrylate ("ASA"), polypropylene ("PP"), low-density polyethylene ("LDPE"), high-density polyethylene ("HDPE"), nylon, etc.). In the un-deflected state, the free end of each of the first tabs 138 is spaced apart from its respective flange 142 by a distance $D_1$, as shown in FIG. 9A. The first tabs 138 can be configured such that the distance $D_1$ is less than the thickness $T_H$ (FIG. 9E) of the head portion 130 of the male component 118*b*. In the deflected state (e.g., FIG. 9B), the free end of each first tab 138 is spaced apart from its respective flange 142 by a distance $D_2$, which is greater than or equal to the thickness $T_H$ of the male component 118*b*.

As shown in FIGS. 2 and 5, the flanges 142 of the locking element 126 can extend laterally from side portions of the guide rails 124 and can be spaced apart from each other. The spacing between the flanges 142 can be configured such that the stem portion 132 of the male component 118*b* move between the flanges 142. As shown in FIG. 9A, in the longitudinal direction (e.g., left/right in the depicted orientation), the flanges 142 can extend over at least part of the first portion 122*a* of the main platform 122 toward the second portion 122*b* of the main platform 122.

Referring still to FIG. 9A, the second tabs 140 of the locking element 126 can each have a fixed end that is coupled to a respective flange 142 and a free end that extends at an angle from the flange 142 toward the first portion 122*a* of the main platform 122. As such, the second tabs 140 form a ramp from the first portion platform 122*a* of the main platform 122 to an outwardly-facing surface of the flanges 142. In some embodiments, the angle between the second tabs 140 and the flanges 142 can be within a range of 91-179 degrees or, in certain embodiments, within a range of 150-175 degrees. In particular embodiments, the angle between the first tabs 138 and the flanges 142 can be within a range of 155-165 degrees.

Figure 9C:
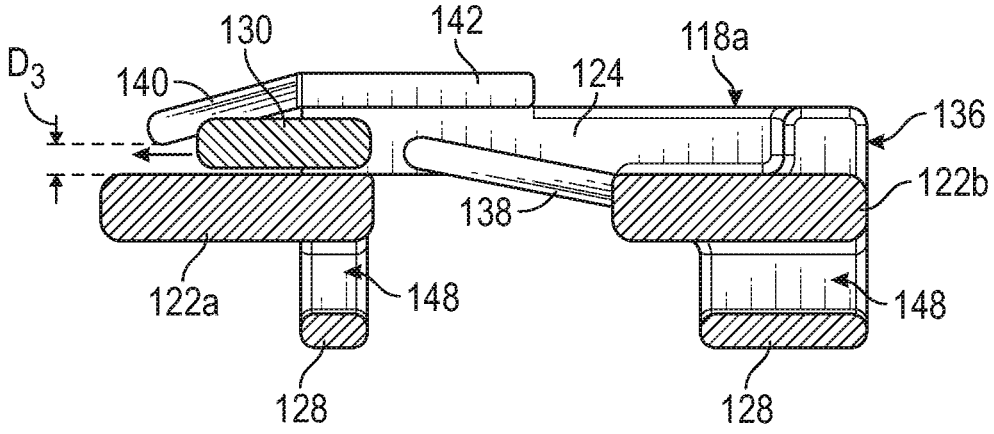
FIG. 9C depicts a cross-sectional view of the clasp of the article of footwear of FIG. 1A, which is taken from the perspective of the line 9-9 of FIG. 5 and shows the clasp in the locked configuration.
Figure 9D:
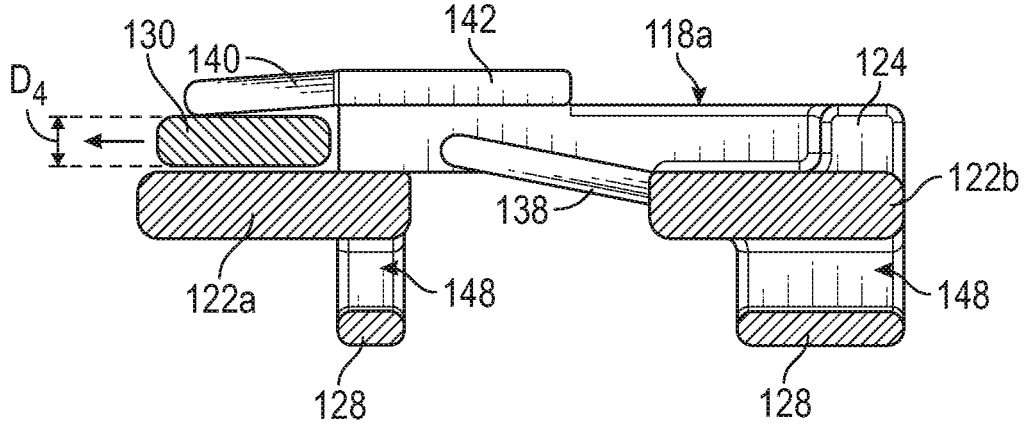
FIG. 9D depicts a cross-sectional view of the clasp of the article of footwear of FIG. 1A, which is taken from a perspective similar to that indicated by the line 9-9 of FIG. 5 and shows the clasp transitioning from the locked configuration to a second unlocked configuration.

The second tabs 140 can be moved between an un-deflected state (e.g., FIG. 9C) and a deflected state (e.g., FIG. 9D). The second tabs 140 are biased to the un-deflected state. In the un-deflected state, the free end of each of the second tabs 140 is spaced apart from the first portion 122*a* of the main platform 122 by a distance $D_3$, as shown in FIG. 9C. The second tabs 140 can be configured such that the distance $D_3$ is less than the thickness $T_H$ (FIG. 9E) of the head portion 130 of the male component 118*b*. In the deflected state (e.g., FIG. 9D), the free ends of the second tabs 140 are spaced apart from the main platform 122 by a distance $D_4$, which is greater than or equal to the thickness $T_H$ of the head portion 130 of the male component 118*b*.

With the locking element 126 of the female component 118*a* configured in this manner, the male component 118*b* can be moved relative to the female component 118*a* from an initial unlocked position (e.g., FIG. 9A), to a locked position (e.g., FIG. 9C), to a final unlocked position (e.g., FIG. 9E), and back to the initial locked position.

The male component 118*b* can be moved from an initial unlocked position (FIG. 9A) to a locked position (FIG. 9C) by advancing the male component 118*b* in the first direction (e.g., left in the depicted orientation) relative to the female component 118*a*. This causes the head portion 130 of the male component 118*b* to move from the second portion 122*b* of the main platform 122 and onto the first tabs 138 of the locking element 126. As the head portion 130 of the male component 118*b* continues in the first direction, the head portion 130 rides up the first tabs 138 until the head portion 130 is wedged between the first tabs 138 and the flanges 142 of the locking element 126. Further movement of the head portion 130 in the first direction causes the first tabs 138 to deflect away from the flanges 142 from the un-deflected state to the deflected state, as shown in FIG. 9B. Once the head portion 130 of the male component 118*b* moves past the first tabs 138 of the locking element 126, the first tabs 138 deflect back toward the flanges 142 (due to the bias of the first tabs 138) from the deflected state back to the un-deflected state, as shown in FIG. 9C.

The relative positioning between the female and male components 118*a*, 118*b* shown in FIG. 9C (see also FIG. 2) is referred to as a "locked configuration" or a "locked position" because the head portion 130 of the male component 118*b* is bound between the main platform 122 and the locking element 126 and thereby restricted from moving relative to the female component 118*a*. In the locked position, the second tabs 140 of the female component 118*a* restrict movement of the head portion 130 of the male component 118*b* in the first direction (e.g., left in the depicted orientation), the first tabs 138 of the female component 118*a* restrict movement of the head portion 130 of the male component 118*b* in a second direction (e.g., right in the depicted orientation), the flanges 142 of the female component 118*a* restrict movement of the head portion 130 of the male component 118*b* in a third direction (e.g., up in the depicted orientation), and the first portion 122*a* of the main platform 122 of the female component 118*a* restricts movement of the head portion 130 of the male component 118*b* in a fourth direction (e.g., down in the depicted orientation). In other words, the first tabs 138 act like a one-way gate that allows the head portion 130 of the male component 118*b* to pass through the gate from a first side of the gate (e.g., FIG. 9A-9B) to a second side of the gate (e.g., FIG. 9C) and prevents the head portion 130 from the second side of the gate back to the first side of the gate.

It should be noted that, although the clasp 118 is shown in FIG. 9C with a longitudinally-extending gap between the head portion 130 of the male component 118*b* and the first tabs 138 of the female component 118*a*, the clasp 118 can be sized and/or configured such that the head portion 130 fits snugly between the first and second tabs 138, 140 in the locked configuration. This can, for example, reduce or eliminate relative movement (e.g., "play") between the female and male components 118*a*, 118*b* when the clasp 118 is in the locked configuration, which in turn provides a relatively more secure feel.

Figure 9E:
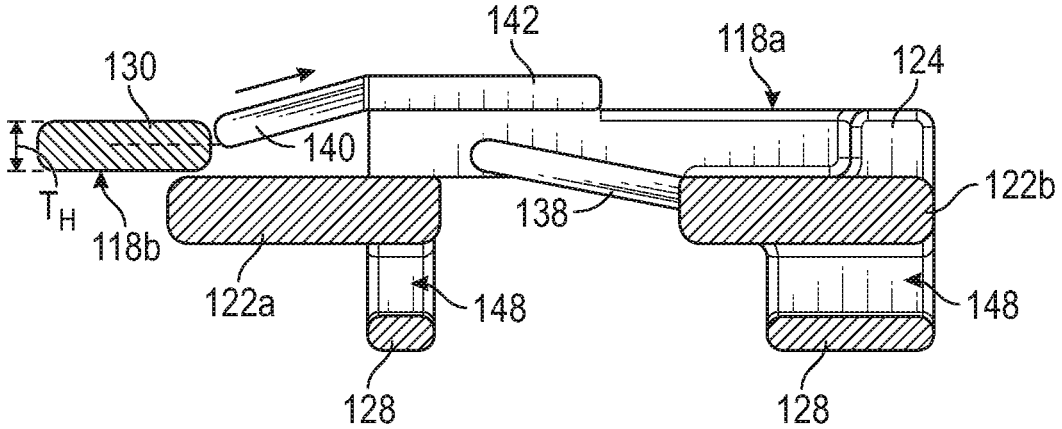
FIG. 9E depicts a cross-sectional view of the clasp of the article of footwear of FIG. 1A, which is taken from a perspective similar to that indicated by the line 9-9 of FIG. 5 and shows the clasp in the second unlocked configuration.

The male component 118*b* can be unlocked from the female component 118*a* by advancing the male component 118*b* further in the first direction relative to the female component 118*a*. This causes the head portion 130 of the male component 118*b* to move along the main platform 122 and press against the second tabs 140 of the locking element 126. As the head portion 130 of the male component 118*b* continues in the first direction, the head portion 130 causes the second tabs 140 to deflect away from the main platform 122 and from the un-deflected state to the deflected state, as shown in FIG. 9D. Once the head portion 130 of the male component 118*b* moves past the second tabs 140 of the locking element 126, the second tabs 140 deflect back toward the main platform 122 (due to the bias of the second tabs 140) and move from the deflected state to the un-deflected state, as shown in FIG. 9E.

Figure 9F:
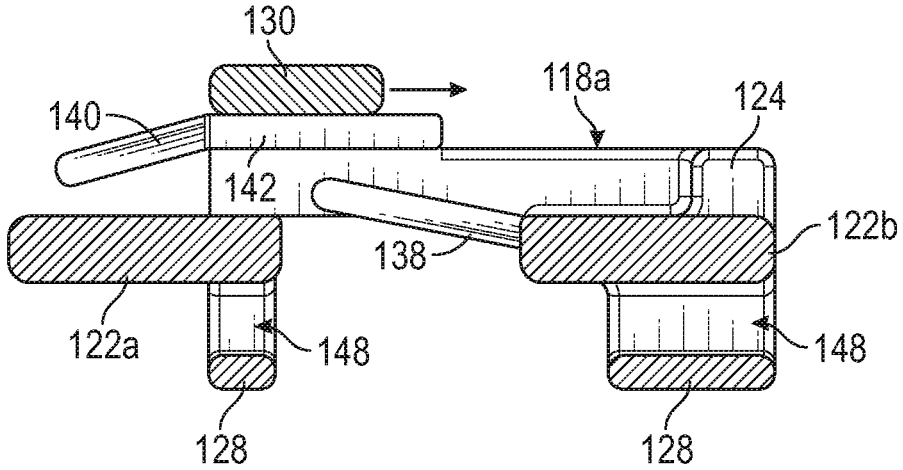
FIG. 9F depicts a cross-sectional view of the clasp of the article of footwear of FIG. 1A, which is taken from a perspective similar to that indicated by the line 9-9 of FIG. 5 and shows the clasp transitioning from the second unlocked configuration to the first unlocked configuration.

From the final unlocked position (FIG. 9E), the male component 118*b* can be moved back to the initial unlocked position (FIG. 9A) by moving the male component 118*b* in the second direction (e.g., right in the depicted orientation). As the male component 118*b* moves in the second direction from the final unlocked position, the head portion 130 of the male component 118*b* moves up the second tabs 140 and onto the outwardly facing surface of the flanges 142, as shown in FIG. 9F. When the head portion 130 moves in the second direction past the flanges 142 of the female component 118*a*, the head can drop down off the flanges 142 and back into the initial unlocked position (FIG. 9A).

In some embodiments, the female and/or male components 118*a*, 118*b* can have one or more features configured to guide and/or assist the head portion 130 of the male component 118*b* to the initial unlocked position relative to the female component 118*a* when the clasp 118 is unlocked. For example, the head portion 130 of the male component 118*b* and the second portion 122*b* of the main platform 122 of the female component 118*a* can each have a magnet coupled thereto, and the magnets can have reverse polarity relative to each other. Accordingly, the head portion 130 and the second portion 122*b* can be drawn together by the magnetic force, thereby positioning the head portion 130 in the initial unlocked position so that it is ready to be locked. In lieu of or in addition to magnets, the article 100 can have one or more biasing members (e.g., elastic straps, springs, etc.) that can also assist and/or guide the female and male components 118*a*, 118*b* to the initial unlocked position relative to each other when the clasp 118 is unlocked.

As the head portion 130 of the male component 118*b* traverses the path depicted in FIGS. 9A-9F, the stem portion 132 of the male component 118*b* can slide between the notch 134 at the first side 136 of the female component 118*a* and the through the gap between the tabs 138, 140 and the flanges 142, as shown in FIG. 5.

The clasp 118 can be coupled to the article 100 in various manners. For example, the attachment element 128 of the female component 118*a* can be configured for coupling the female component 118*a* to the article 100. In the illustrated embodiment, the attachment element 128 includes slots 148. The slots 148 can be configured to receive a portion of the upper 104 of the article 100 and/or a fastener (e.g., a fabric or polymeric strip) that is used to couple the female component 118*a* to the upper 104. In lieu of or in addition to the upper and or the fastener extending through the attachment element 128, the female component 118*a* can be coupled to the upper 104 of the article 100 in various other ways, such as with adhesive and/or other coupling means. In some embodiments, the attachment element can be omitted.

In some embodiments, the female component 118*a* can be coupled to the first portion 104*a* of the upper, and the male component 118*b* can be coupled to the second portion 104*b* of the upper, or vice versa.

The male component 118*b* can be coupled to the article 100 in various ways such as by fasteners extending through the openings 146 of the male component and/or other coupling means (e.g., adhesive).

With the clasp 118 coupled to the upper 104 of the article 100, the wearer can use the clasp 118 to adjust the opening 116 of the article 100. For example, with the clasp 118 in the open configuration shown in FIG. 1B, the opening 116 can be expanded and the wearer can insert their foot into the opening 116 such that their toes and forefoot extend into the front portion 104*a* of the upper and their heel is directed toward the back portion 104*b* of the upper. The wearer can secure their foot within the article 100 by moving the clasp 118 from the initial unlocked position to the locked position (e.g., as described above with respect to FIGS. 9A-9C). This constricts the opening 116 around the wearer's foot and secures the front and back portions 104*a*, 104*b* of the upper 104 relative to each other. The wearer can remove their foot from the article by moving the clasp 118 from the locked position to the final unlocked position (as described above with respect to FIGS. 9C-9E). This allows the front and back portions 104*a*, 104*b* of the upper to move relative to each other and the opening 116 of the article to expand away from the wearer's foot.

In some embodiments, the front and back portions 104*a*, 104*b* can have a biasing member (e.g., an elastic strap or a tension spring) that is coupled to the front and back portions 104*a*, 104*b* and that biases the front and back portions 104*a*, 104*b* toward each other. In such embodiments, the wearer could insert their foot into the opening 116 by separating the front and back portions 104*a*, 104*b* from each other. Once their foot is in place, the wearer could release the front and back portions 104*a*, 104*b* and the bias of the biasing member could move the clasp to the secured/locked position (FIG. 9C) without additional input from the wearer. The wearer can remove their foot from the article 100 by moving the clasp to the unsecured/unlocked position (FIG. 9E) and separating the front and back portions 104*a*, 104*b* from each other and withdrawing their foot from the opening 116.

In other embodiments, the front and back portions 104*a*, 104*b* can have a biasing member (e.g., a compression spring) that is coupled to the front and back portions 104*a*, 104*b* and that biases the front and back portions 104*a*, 104*b* away from each other. In such embodiments, the biasing member would separate the front and back portions 104*a*, 104*b* from each other (e.g., FIG. 1B), and the wearer could insert their foot into the opening 116. The wearer could secure their foot within the article 100 by urging the front and back portions 104*a*, 104*b* together and securing the clasp 118 in the secured position (e.g., FIG. 9C). The wearer can remove their foot from the article 100 by moving the clasp to the unsecured/unlocked position (FIG. 9E). The bias of the biasing member would separate the front and back portions 104*a*, 104*b* from each other, and the wearer can withdrawing their foot from the opening 116.

The clasp 118 provides several advantages over typical buckles or other typical securing mechanisms. For example, the clasp 118 can be locked and unlocked relatively more easily than typical buckles. This is because the clasp 118 is locked by pushing the male component 118*b* in a first direction relative to the female component 118*a* and is unlocked by pushing the male component 118*a* further in the first direction relative to the female component 118*a*. The locking/unlocking motion occurs in a single plane and in a single direction. For example, pushing the male component 118*a* in a first direction relative to the female component 118*a* can both lock and unlock the clasp 118 depending on the distance the male component is moved relative to the female component. As such, the clasp 118 can be actuated, for example, by wearers with low dexterity (e.g., children, elderly, disabled) and/or wearers that are in a hurry (e.g., emergency workers). In certain embodiments, a wearer can even actuate the clasp 118 without the use of finger, hands, and/or arms. For example, the user could use their other foot to actuate the clasp. This is an advantage over typical buckles, laces, and other common securing mechanisms which require high dexterity in order to perform the multiple types of motion (e.g., pushing, squeezing, pulling, lifting, etc.) in multiple directions (e.g., forward, backward, upward, downward, etc.) to actuate the buckles.

Figure 11:
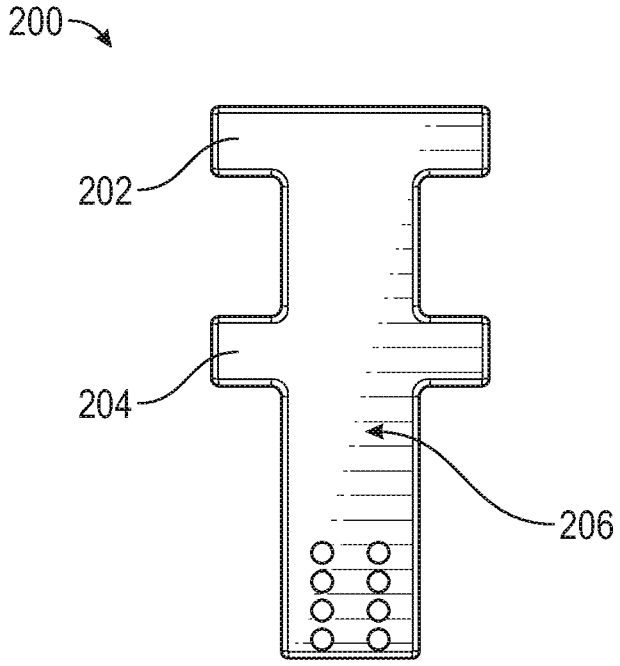
FIG. 11 depicts a top plan view of an exemplary male component of a clasp for a closure mechanism.

FIG. 11 shows an exemplary embodiment of a male component 200 of a clasp that can be moved between unlocked and locked positions by moving one component in a first direction relative to another component. The male component or projection 200 can be used, for example, with the female component 118*a* of the article 100 in lieu of the male component 118*b*. The male component 200 is configured generally similar to the male component 118*b* of the article 100, except that the male component 200 has a plurality of head portions extending from a stem portion of the male component 200. For example, the male component has a first head portion 202 and a second head portion 204 extending from an elongate stem portion 206. Configuring the male component 200 in this manner can, for example, allow a wearer to adjust and/or customize the fit of the article. For example, if the wearer desires a relaxed or relatively looser fit, the wearer can insert the male component 200 into the female component 118*a* such that the first head portion 202 is in the locked position (see FIG. 9C). If the wearer desires an active or relatively tighter fit, the wearer can further advance the male component 200 into the female component 118*a* such that the second head portion 204 is in the locked position and the first head portion 202 is in the unlocked position.

It should be noted that more a male component can include more than two head portions (e.g., 3-6 or more). It should also be noted that the spacing between adjacent head portions can be varied to customize the degree in which each successive head portion tightens the clasp. For example, in some embodiments, the spacing between adjacent head portions can be evenly distributed (e.g., each head portion is 2.5 mm from an adjacent head portion). As such, moving the male component relative to the female component from one head portion to next increases or decreases the tightness of the opening to which the clasp is attached in a linear fashion. In other embodiments, the spacing between adjacent head portions can be unevenly distributed (e.g., the spacing between adjacent head portions at one end of the male component 200 is larger or smaller than the spacing between adjacent head portion at the other end of the male component 200). Accordingly, moving the male component relative to the female component from one head portion to next increases or decreases the tightness of the opening to which the clasp is attached in a non-linear fashion.

Figure 12:
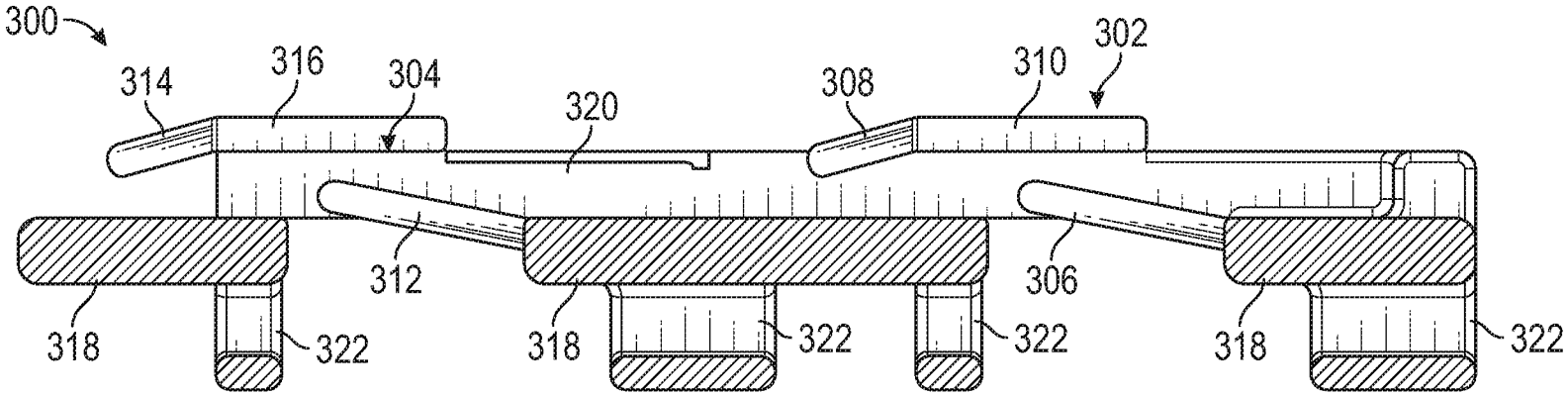
FIG. 12 depicts a cross-sectional view of an exemplary female component of a clasp for a closure mechanism.

FIG. 12 shows an exemplary embodiment of a female component 300 of a clasp that can be moved between unlocked and locked positions by moving one component in a first direction relative to another component. The female component 300 can be used, for example, with the male component 118*b* of the article 100 or the male component 200. The female component 300 is configured generally similar to the female component 118*a* of the article 100, except that the female component 300 has a plurality of locking elements. For example, the female component 300 has a first locking element 302 and a second locking element 304 that are lined up in series. It should be noted, however, that the female component 300 can have more than two locking elements (e.g., 3-6 or more). The first locking element 302 can include first tabs 306, second tabs 308, and first flanges 310. The second locking element 304 can include third tabs 312, fourth tabs 314, and second flanges 316. The first and second locking elements 302, 304 and their components can each be configured similar to the locking element 126 of the clasp 118 and its components.

The female component 300 can also include a main platform 318, guide rails 320, and one or more attachment elements 322. These components can be configured similar to the main platform 122, the guide rails 124, and the attachment element 128 of the female component 118*a*, respectively.

Configuring the female component 300 in this manner can, for example, allow a wearer to adjust and/or customize the fit of the article to which the clasp is attached. For example, if the wearer desires a relaxed or relatively looser fit, the wearer can insert a male component (e.g., the male components 118*b*, 200) into the female component 300 such that the head portion of the male component is positioned in a first locked position relative to the first locking element 302. In the first locked position, the head portion of the male component is disposed between the first tabs 306 and the second tabs 308 of the first locking element 302. If the wearer desires a more active or relatively tighter fit, the wearer can further advance the male component into the female component 300 such that the head portion is positioned in a second locked position relative to the second locking element 304. In the second locked position, the head portion of the male component is disposed between the third tabs 312 and the fourth tabs 314 of the second locking element 304. The wearer can unlock the clasp from either the first or second locking element 302, 304 by pushing the head portion of the male component past the second tabs 308 or the fourth tabs 314.

A female component having multiple locking elements (e.g., the female component 300) can be paired with a male component having multiple head portions (e.g., the male component 200). This can be accomplished, for example, by configuring the spacing between the first and second head portions 202, 204 of the male component 200 to correspond to the spacing between the first and second locking elements 302, 304 of the female component 300. This configuration can, for example, provide increased adjustability/customization. For example, a clasp comprising the male component 200 and the female component 300 can be locked in three different locked configurations.

In a first locked configuration, the first head portion 202 of the male component 200 can be locked between the first and second tabs 306, 308 of the female component 300 and the second head portion 204 of the male component 200 is in initial unlocked position.

In a second locked configuration, the first head portion 202 of the male component 200 is locked between the third and fourth tabs 312, 314 of the female component 300 and the second head portion 204 of the male component 200 is locked between the first and second tabs 306, 308 of the female component 300. The second locked configuration can, for example, provide additional security to help ensure that the male and female components remain in the second locked configuration. This is because the first head portion 202 of the male component 200 is locked with the second locking element 304 of the female component 300 and the second head portion 204 of the male component 200 is locked with the first locking element 302 of the female component 300. In this manner, the male and female components are "double locked" relative to each other, thus reducing the likelihood that the clasp will be inadvertently uncoupled. This configuration can also increase the strength of the connection by distributing a load on the clasp over two head portions and two locking elements.

In a third locked configuration, the second head portion 204 of the male component 200 is locked between the third and fourth tabs 312, 314 of the female component 300 and the first head portion 202 is in the final unlocked position.

Figure 13:
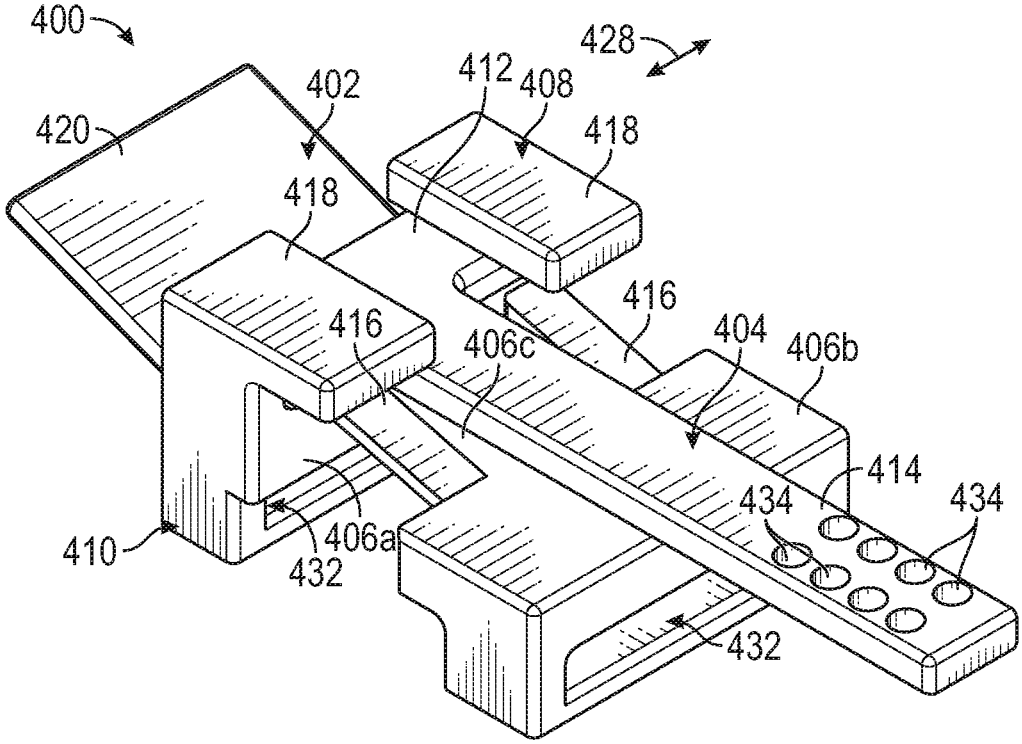
FIG. 13 depicts a perspective view of another exemplary embodiment of a clasp for a closure mechanism.
Figure 14:
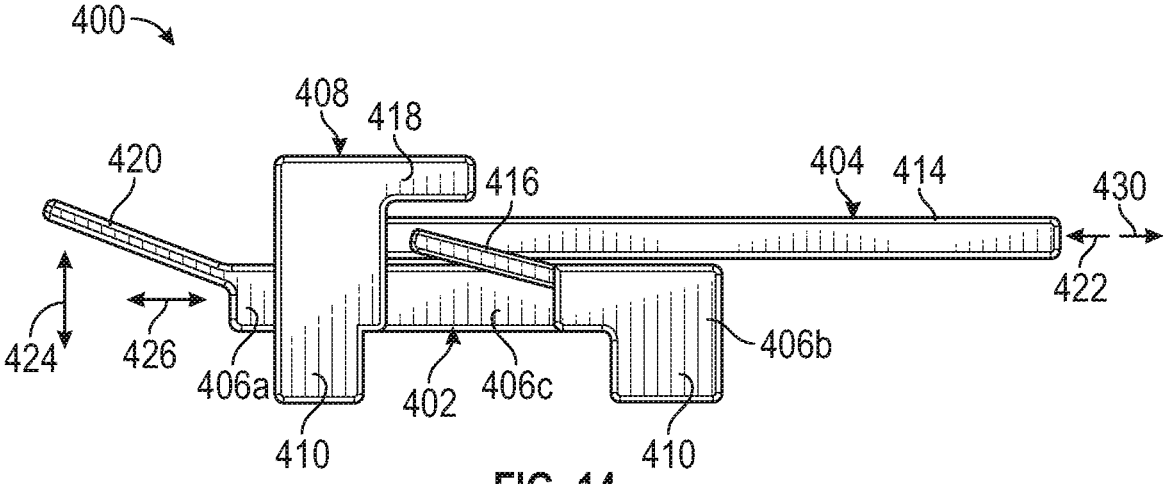
FIG. 14 depicts a side elevation view of the clasp of FIG. 13.

FIGS. 13-14 show an exemplary embodiment of a clasp 400 that can be moved between unlocked and locked positions by moving one component in a first direction relative to another component. The clasp 400 is configured generally similar to the clasp 118 of the article 100 in that the clasp 400 has a female component 402 and a male component 404 that are lockable and unlockable relative to each other by moving the components 402, 404 in a single direction relative to each other.

The female component 402 of the clasp 400 can include a main platform 406, a locking element 408, and an attachment element 410. The male component 404 can include a head portion 412 and a stem portion 414 extending from the head portion 412. The main platform 406 of the female component 402 can be configured to support the head and/or stem portions 410, 412. The locking element 408 of the female component 402 can be configured to engage the head portion 412 of the male component 404 in order to restrict or prevent relative movement between the female and male components 402, 404. The attachment element 410 of the female component 402 can be configured for coupling the female component 402 to an article of footwear or an article of apparel.

The main platform 406 of the female component 402 can include a generally flat surface. In some embodiments, the main platform 406 can be generally "I-shaped" having first and second portions 406*a*, 406*b* that extend laterally and a third portion 406*c* that extends longitudinally between the first and second portions 406*a*, 406*b*. The portions 406*a*, 406*b*, 406*c* are collectively and/or generically referred to herein as the "main platform 406."

The locking element 408 can include a plurality of tabs 416, a plurality of flanges 418, and a ramp member 420. The tabs 416 and the flanges 418 of the clasp 400 can be configured similar to the first tabs 138 and the flanges 142 of the clasp 118, respectively. For example, the tabs 416 extend at an angle from the second portion 406*b* of the main platform 406 toward the flanges 418. The tabs 416 are biased toward the flanges 418 in an un-deflected state, configured to deflect away from the flanges 418 as the head portion 412 of the male component 404 passes between the tabs 416 and the flanges 418 moving in a first direction (e.g., the direction shown by arrow 422 in FIG. 14), and configured to return to their un-deflected state once the head portion 412 passes by the tabs 416. As shown in FIG. 14, the flanges 418 can be spaced from the main platform 406 in a vertical direction (i.e., the direction shown by arrow 424), and each flange 418 can extend over at least a portion of a respective tab 416 in a longitudinal direction (i.e., the direction shown by arrow 426). As shown in FIG. 13, each of the flanges 418 can also extend over a respective tab 416 in a lateral direction (i.e., the direction shown by arrow 428). The flanges 418 can be spaced apart from each other and define a gap or slot therebetween in the lateral direction.

The ramp member 420 can be coupled to and extend vertically upward and longitudinally away from the first portion 406*a* of the main platform 406. The ramp member 420 can be angled relative to the main platform 406 at an angle within the range of 91-179 degrees or, in some embodiments, within the range of 150-175 degrees. In particular embodiments, the ramp member 420 can be angled relative to the main platform 406 at an angle within the range of 155-165 degrees. In this manner, the ramp member 420 can provide at least some resistance to prevent the head portion 412 from moving freely in the first direction longitudinally and becoming inadvertently moved from the locked position to an unlocked position. This is because the head portion 412 of the male component 404 begins to contact the ramp member 420 of the female component 402 before the head portion 412 is exposed from under the flanges 418 of the female component 402.

Accordingly, the male component 404 is locked relative to the female portion 402 when the head portion 412 of the male component 404 is positioned such that the tabs 416 and ramp member 420 of the female portion 402 can restrict motion of the head portion 412 in the longitudinal direction, and the main platform 406 and the flanges 418 of the female component 402 can restrict motion of the head portion 412 in the vertical and lateral directions.

To unlock the male component 404 from the female component 402, the male component 404 can be advanced longitudinally in the first direction relative to the female component 402 such that the head portion 412 of the male component 404 moves up the ramp member 420 of the female component 402 and vertically clears the flanges 418 of the female component 402. At this final unlocked configuration, the male portion 404 can be moved longitudinally in a second direction (e.g., the direction shown by arrow 430 in FIG. 14) such that the head portion 412 of the male component 404 moves over the upwardly-facing surfaces of flanges 418 and back to the initial unlocked position.

The female component 402 can be coupled to an article of footwear or an article of apparel in various ways. For example, in some embodiments, the female component 402 can be coupled to the upper of an article of footwear by positioning a portion of the upper and/or one or more fasteners (e.g., stitching, rivets, bolts, screws, etc.) through slots 432 of the attachment elements 410. Additionally or alternatively, the female component 402 can be coupled to the article with adhesive and/or a means for bonding.

The male component 404 can be coupled to an article of footwear or an article of apparel in various ways. For example, in some embodiments, the male component 404 can be coupled to the upper of an article of footwear by positioning one or more fasteners (e.g., stitching, rivets, bolts, screws, etc.) through openings 434 of the male component 404. Additionally or alternatively, the male component 404 can be coupled to the article with adhesive and/or another means for bonding.

Figure 15:
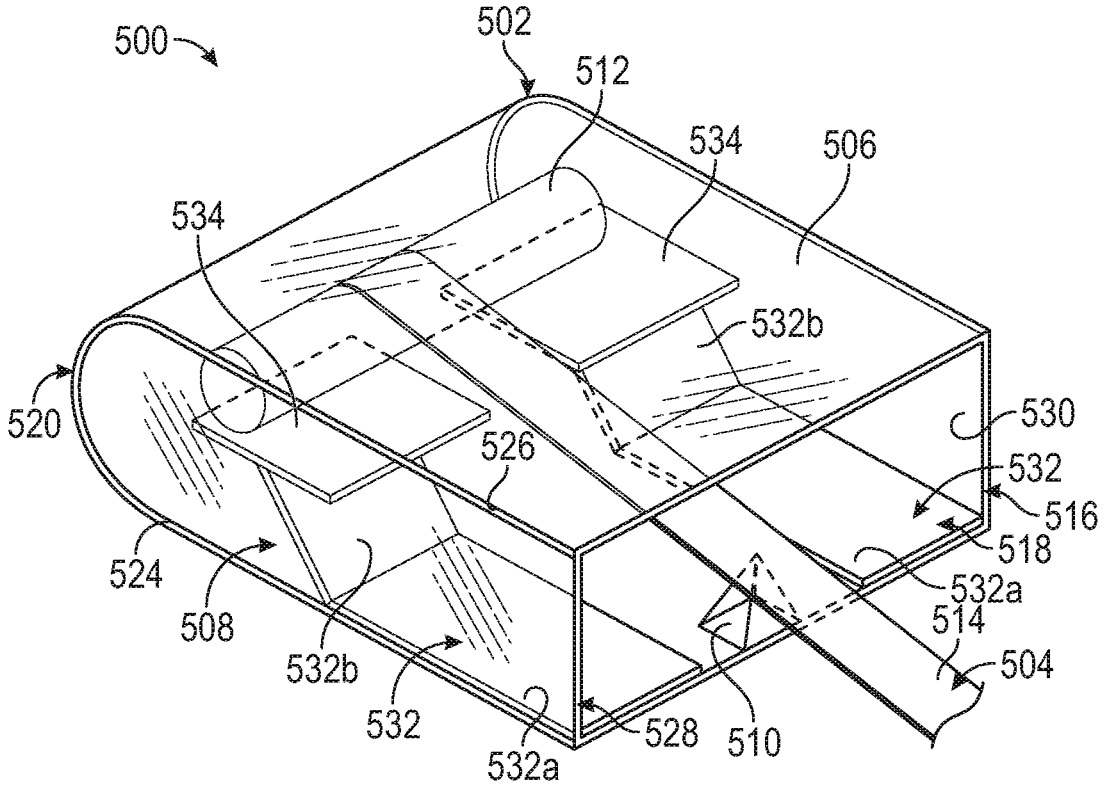
FIG. 15 depicts a perspective view of another exemplary embodiment of a clasp for a closure mechanism.
Figure 16A:
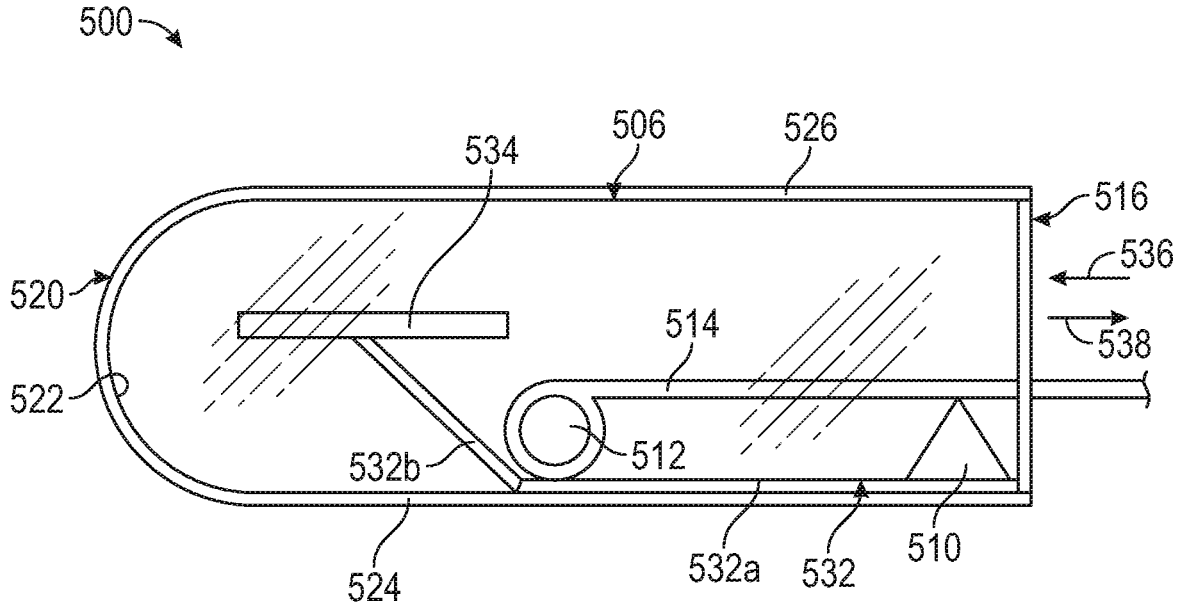
FIG. 16A depicts a side elevation view of the clasp of FIG. 15, showing the clasp in an unlocked configuration.
Figure 16B:
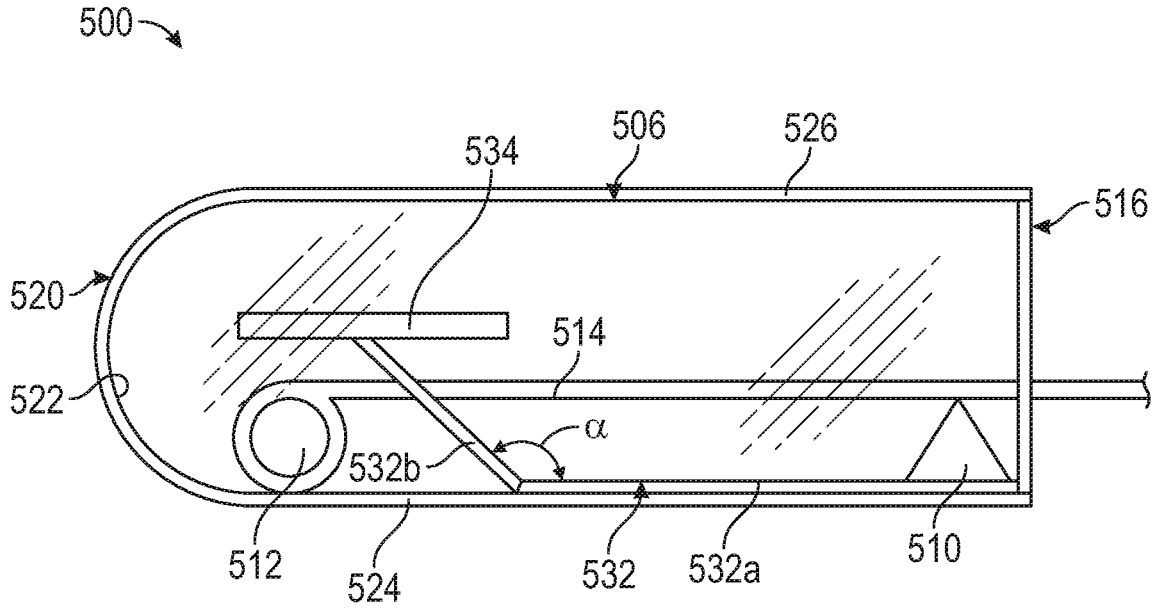
FIG. 16B depicts a side elevation view of the clasp of FIG. 15, showing the clasp in a locked configuration.
Figure 16C:
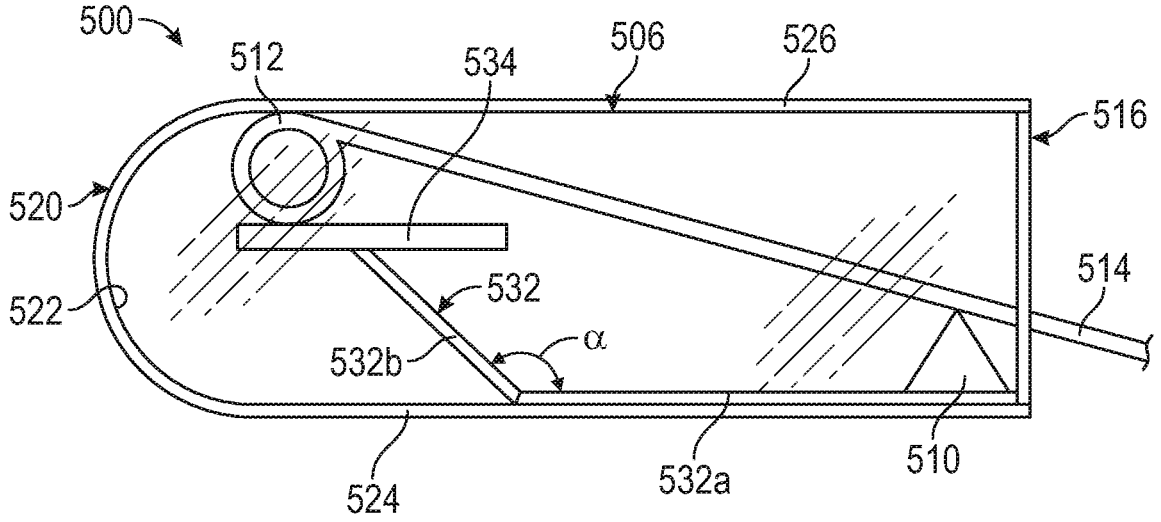
FIG. 16C depicts a side elevation view of the clasp of FIG. 15, showing the clasp transitioning from the locked configuration to the unlocked configuration.

FIGS. 15-16C show an exemplary embodiment of a clasp 500 that can be moved between unlocked and locked positions by moving one component in a first direction relative to another component. For example, the clasp 500 can be coupled to and used with articles of footwear and/or articles of apparel in a manner similar to that shown with the clasp 118 of the article 100. Like the other clasps described herein, the clasp 500 can provide a relative quick and easy mechanism for securing an opening of an article to which the clasp 500 is attached.

Referring to FIG. 15, the clasp 500 can include a female component 502 and a male component 504 that are movable between an unlocked configuration (FIG. 16A) and a locked configuration (FIG. 16B). In the unlocked configuration, the male component 504 can be inserted into and moveable relative to the female component 502. In the locked configuration, the male component 504 is held within the female component 502 and restricted from moving relative the female component 502. As such, the clasp 500 can be used, for example, to release or expand an opening of an article when the clasp 500 is in the unlocked configuration and to secure or restrict the opening of the article when the clasp 500 is in the locked configuration.

The female component 502 of the clasp 500 can include a cover or housing 506, a locking element 508, and a fulcrum 510. The locking element 508 and the fulcrum 510 can be disposed within the housing 506. The housing 506 can be configured to act as a guide for the male component 504 as the male component 504 moves relative to the female component 502 between the unlocked and locked configurations. The locking element 508 can be configured to restrict movement between the female and male components 502, 504 within the housing 506. The fulcrum 510 can act as a point about which the male component 504 can pivot and move relative to the female component 502, for example, when moving the clasp 500 between the unlocked and locked configurations.

The male component 504 of the clasp 500 can include a head portion 512 and a stem portion 514 coupled to and extending from the head portion 512. In some embodiments, the head and stem portions 512, 514 can be integrally formed as a unitary component. In other embodiments, the head and stem portions 512, 514 can be formed as separate components that are coupled together (e.g., with fasteners, adhesive, and/or other coupling means). The head portion 512 of the male component can be cylindrical, rounded, and/or any other shape that allows the head portion 512 to move relatively easily relative to the housing 506. In the illustrated embodiment, the stem portion 514 extends from an upper location of the head portion 512. In other embodiments, the stem portion can extend from other locations of the head portion 512, such as a central location (e.g., a location that intersects the longitudinal axis of the head portion) or a lower location.

Referring to FIG. 16A, the housing 506 of the female component 502 can, in some embodiments, have a generally "U-shaped" or "D-shaped" profile when viewed from a side of the cover (e.g., the view illustrated in FIGS. 16A-16C). Referring again to FIG. 15, a first end portion 516 of the housing 506 can have an opening 518 formed therein that is configured for receiving the male component 504. Referring again to FIG. 16A, a second end portion 520 of the housing 506 can have a curved inwardly-facing surface 522 extending between a first wall 524 (e.g., a lower wall) and a second wall 526 (e.g., an upper wall) of the housing 506. Generally speaking, the surface 522 of the housing 506 resembles a halfpipe. The housing 506 can also have third and third and fourth walls 528, 530 (e.g., side walls), as shown in FIG. 15.

It should be noted that the housing 506 is shown as transparent in FIGS. 15-16C so that the various components disposed within the housing 506 can be seen. The housing 506 can be formed from various transparent or non-transparent materials.

As shown in FIG. 15, the locking element 508 can be disposed in the housing 506 and can include a plurality of tabs 532 (e.g., two) and a plurality of flanges 534 (e.g., two). In some embodiments, the tabs 532 can each have an attachment portion 532*a* and a gate portion 532*b*. The attachment portion 532*a* of each tab 532 can be coupled to the first wall 524 of the housing 506, and the gate portion 532*b* of each tab 532 can extend at an angle from the attachment portion 532*a* toward a respective flange 534. In other embodiments, the attachment portions 532*a* of the tabs 532 can be omitted, and the gate portions 532*b* of the tabs 532 can be integrally formed or directly coupled to the first wall 524 of the housing 506. Each of the flanges 534 can be coupled to a respective side wall 528, 530 at a location between the first and second walls 524, 526. The tabs 532 and the flanges 534 can be disposed within the housing 506 such that there is a lateral gap between the tab and flange that are disposed on one side of the housing and the tab and flange that are disposed on the other side of the housing. The gap can allow the stem 514 of the male component 504 to pass between the tabs and flanges as the male component 504 moves between the locked and unlocked configurations.

The gate portions 532*b* of the tabs 532 can be biased to an un-deflected state and configured to pivot between the un-deflected state and a deflected state. In the un-deflected state, the gate portions 532*b* are angled at a first angle $\alpha$ relative to the attachment portions 532*a* and/or the first wall 524, as shown in FIG. 16B. The angle $\alpha$ can be within the range of 91-179 degrees or, more particularly, within a range of 120-160 degrees. In certain embodiments, the angle $\alpha$ can be within the range of 130-150 degrees.

The fulcrum 510 of the female component 502 can be used to move the male component 504 from the locked configuration to the unlocked configuration. The fulcrum 510 of the female component 502 can be disposed on the first wall 524 within the housing 506 at a location that is laterally aligned with the gap between the tabs and flanges. In some embodiments, the fulcrum 510 and the housing 506 are integrally formed as a single, unitary component. In other embodiments, the fulcrum 510 and the housing 506 are formed as separate components, and the fulcrum is coupled to the first wall 524 of the housing 506 (e.g., with a fasteners, adhesive, and/or other means for coupling). The fulcrum 510 is configured to engage the stem 514 of the male component 504 such that the male component 504 can pivot vertically about the fulcrum 510 as the male component 504 moves between the locked and unlocked configurations, as shown in FIGS. 16B-16C.

The fulcrum of the female component and/or the head portion of the male component can be sized and/or configured to position the stem portion of the male component at various angles relative to the housing. The angle can be selected, for example, to facilitate or restrict relative movement between the female and male components. For example, in the illustrated embodiment, the fulcrum 510 has a height that is equal or at least substantially equal to the height (e.g., diameter) of the head portion 512, as shown in FIG. 16A. As such, the stem portion 514 is parallel or at least substantially parallel to the first wall 524 of the housing 506 when the clasp 500 is in the positions shown in FIGS. 16A and 16B. This configuration can, for example, facilitate longitudinal movement (e.g., left/right in the orientation depicted in FIGS. 16A-16C) of the male component 504 relative to the female component. In other embodiments, the fulcrum and/or the head portion can be sized and/or configured such that the stem portion is not parallel nor substantially parallel to the first wall 524 of the housing 506 when the clasp 500 is in the positions shown in FIGS. 16A and 16B. This can be accomplished, for example, by forming the fulcrum and the head portion with different heights. In particular embodiments, the height of the fulcrum can be greater than the height of the head portion. This configuration can, for example, facilitate vertical movement (e.g., up/down in the orientation depicted in FIGS. 16A-16C) of the head portion by providing additional room for the end of the stem portion (e.g., the right-most end of the stem in orientation depicted in FIGS. 16A-16C) to move vertically downward as the head portion male component moves from the locked position to the unlocked position (e.g., FIG. 16C).

In some embodiments, the fulcrum 510 and/or the male component 502 can have a stabilizing or support member that allows the male component to move along its longitudinal axis relative to the fulcrum and that prevents the male component from moving laterally relative to the fulcrum, while still allowing the male component 504 to pivot vertically relative to the fulcrum. This can be accomplished, for example, by configuring the stem 514 with a groove on the surface of the stem 514 that contacts the fulcrum and by configuring the fulcrum 510 with a corresponding projection that is configured to extend into the slot. In this manner, the groove acts as a rail along which the projection of the fulcrum 510 can move. As another example, the fulcrum could comprise a stirrup or cradle that is configured to extend around the bottom and sides of the stem 514. As yet another example, the fulcrum could comprise an opening having a lateral width that was only slightly larger than the width of the stem 514 but had a height that was greater than the thickness of the stem. A movable hinge could also be incorporated into one or more of these examples.

The clasp 500 can be locked and unlocked by moving the female and male components 502, 504 relative to each other. For example, FIG. 16A shows the clasp 500 in the unlocked configuration. FIG. 16B shows the clasp 500 in the locked configuration. FIG. 16C shows the clasp transitioning from the locked configuration to the unlocked configuration.

To move the clasp 500 from the unlocked configuration (FIG. 16A) to the locked configuration (FIG. 16B), the male component 504 can be moved relative to the female component 502 such that the head portion 512 of the male component 504 moves in a first direction (i.e., the direction shown by the arrow 536 in FIG. 16A) and contacts the gate portions 532*b* of the female component 504. As the head portion 512 is urged in the first direction, the gate portions 532*b* deflect away from the flanges 534 until the head portion 512 passes between the gate portions 532*b* and the flanges 534. This increases first angle α of the tabs 532 to a second angle that greater than the angle α and less than or equal to 180 degrees. When the head portion 512 moves past the gate portions 532*b*, the gate portions 532*b* can return from the deflected state back to the un-deflected state due to the bias of the gate portions 532*b* toward the un-deflected state. The head portion 512 is now in the locked configuration because the gate portions 532*b* of the tabs 532 prevent the head portion 512 of the male component 504 from moving in a second direction (i.e., the direction shown by the arrow 538 in FIG. 16A) relative to the female component 502, as shown in FIG. 16B. Also, the curved, inwardly-facing surface 522 of the housing 506 restricts movement of the male component 504 in the first direction.

The clasp 500 can be moved from the locked configuration (FIG. 16B) to the unlocked configuration (FIG. 16A) by advancing the male component 504 in the first direction such that the head portion 512 of the male component 504 contacts and follows the curve of the inwardly-facing surface 522 of the housing 506. As the head portion 512 of the male component 504 moves vertically upward relative to the tabs 532 and the flanges 534, the stem portion 514 of the male component 504 pivots relative to the fulcrum 510 of the female component 502. When the head portion 512 of male component 504 reaches the vertex of the surface 522 of the housing 506, the head portion 512 begins moving in the second direction (rather the first direction) while it continues to move vertically upward relative to the tabs 532 and the flanges 534. As the head portion 512 moves in the second direction along the housing 506, the head portion passes between the second wall 526 of the housing 506 and the upper surface of the flange 534. Stated another way, the curved, inwardly-facing surface 522 of the housing 506 can act as a ramp that guides the head portion 512 of the male component 504 from a position under the flanges 534 (e.g., FIG. 16B) to a position over the flanges 534 (e.g., FIG. 16C). The head portion 512 can continue to move along the upper surfaces of the flanges 534 in the second direction until the head portion reaches the edge of the flanges. At this point, the head portion 512 of the male component can move vertically downward from the flanges 534 and return to the unlocked configuration (FIG. 16A).

In some embodiments, the surface 522 of the housing 506 (and/or other portions of the female and male components 502, 504) can be formed from a relatively smooth material and/or have a coating applied thereto to facilitate movement of the head portion 512 of the male component 504 relative to the female component 502. For example, a polytetrafluorethylene ("PTFE") coating can be applied to the surface 522 and/or the head portion 512.

Like the other disclosed clasps, the clasp 500 provides a relatively quick and easy mechanism for securing article of apparel and/or articles of footwear. For example, a wearer can actuate the clasp 500 by moving the male component 504 of the clasp 500 with their hand and/or foot. As such, a user does not need high dexterity and/or fine motor skills to move the clasp 500 between the unlocked and locked configurations.

Figure 17A:
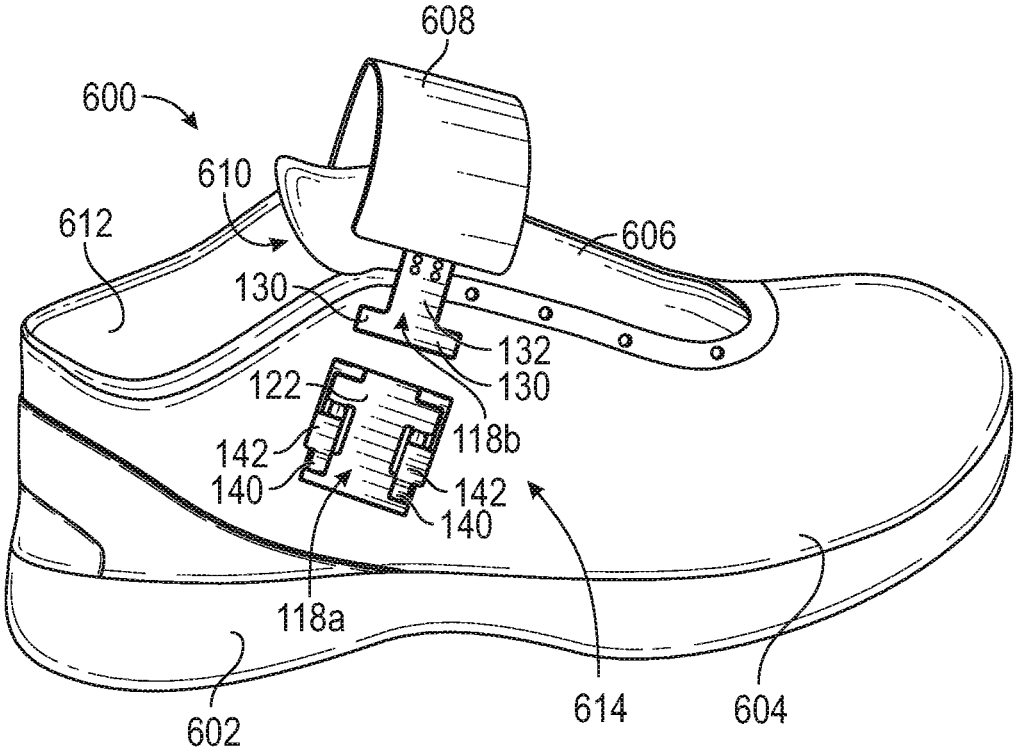
FIG. 17A depicts a perspective view an article of footwear having an exemplary closure mechanism that includes a clasp, which is shown in an unlocked configuration.
Figure 17B:
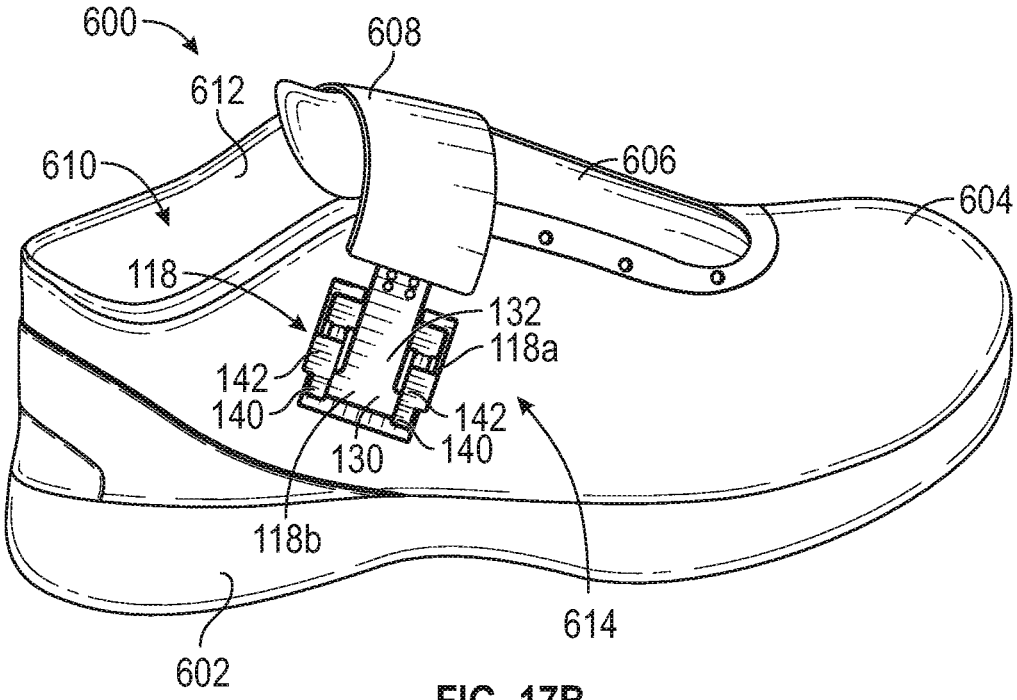
FIG. 17B depicts a perspective view of the article of footwear of FIG. 17A, showing the clasp of the closure mechanism in a locked configuration.

FIGS. 17A-17B show an exemplary article of footwear 600 comprising a sole structure 602, an upper 604, a tongue 606, and a strap 608. Also, the article 600 can comprise a closure mechanism that can be easily opened and closed for adjusting and/or securing the size of a foot opening 610 of the article 600. For example, the closure mechanism can be opened and closed with one hand, and/or by a person with low dexterity and/or lacking fine motor skills. In some embodiments, the closure system can have a first component coupled to a medial side portion of the article and a second component coupled to a lateral side portion of the article.

For example, in the illustrated embodiment, the closure mechanism of the article 600 comprises the strap 608 and the clasp 118 for adjusting and/or securing the opening 610 of the article. A first end portion (e.g., a fixed end portion) of the strap 608 can be coupled to and/or extend from a medial side portion 612 of the upper 604, and a second end portion (e.g., a free end portion) of the strap 608 can extend to a lateral side portion 614 of the upper 604, or vice versa. The second end portion of the strap 608 can be releasably coupled to the lateral side portion 614 of the upper 604 via the clasp 118. For example, FIG. 17A shows the clasp 118 in an unlocked configuration which allows the second end portion of the strap 608 to be separated from the lateral side 614 of the upper 604, thus allowing the opening 610 of the article 600 to expand. FIG. 17B shows the clasp 118 in a locked configuration which restricts relative movement between the strap and the lateral side portion 614 of the upper 604, and therefore secures the size and/or configuration of the opening 610 of the article 600.

As described above, particularly with reference to FIGS. 2-10, the clasp 118 has a female component 118*a* and a male component 118*b*. In the illustrated embodiment, the female component 118*a* is coupled to the lateral side 614 of the upper 604, and the male component 118*b* is coupled to the second end portion of the strap 608. In other embodiments, the orientation of the clasp 118 can be reserved such that the male component 118*b* is coupled to the lateral side 614 of the upper 604, and the female component 118*a* is coupled to the second end portion of the strap 608.

The female and male components 118*a*, 118*b* of the clasp 118 can be coupled to the upper 604 and/or the strap 608 in various ways. For example, the components can be coupled to the upper/strap with adhesive, stitching, and/or fasteners (screws, rivets, etc.).

As shown in the illustrated embodiment, the component of the clasp 118 that is coupled to the strap 608 (e.g., the male component 118*b*) can extend from the end of the strap 608 such that the clasp 118 is exposed from the strap when the strap 608 and the clasp 118 are in the unlocked configuration (FIG. 17A) and the locked configuration (FIG. 17B). In other embodiments, the strap and/or the clasp can be configured such that the strap 608 partially or fully conceals the clasp 118 when the strap and clasp are in the locked configuration (FIG. 17B). This can be accomplished, for example, by coupling the male component 118*b* of the clasp 118 to the strap 608 such that the strap 608 overlaps the male component 118*b*. In other words, the male component 118*b* can be disposed "under" the strap 608.

In lieu of the strap 608, the clasp 118 can be configured such that the male component 118*b* can be coupled directly to the medial side portion 612 of the upper 604. For example, the stem portion 132 of the male component 118*b* can be lengthened such that the male component can extend from the medial side portion 612, across the tongue 606, and to the lateral side portion 614.

In some embodiments (with or without a strap), the female and/or male components can be curved (e.g., non-flat) and/or flexible so as to follow the curvature of the upper and/or a foot. For example, the male component 118*b* can be curved to follow the curvature of the upper across the tongue 606 and/or the top (i.e., superior) side of a wearer's foot.

In particular embodiments, the tension applied to the upper 604 by the strap 608 and/or the clasp 118 can be adjusted. This can, for example, allow a wearer to adjust the size of the opening when the clasp 118 is in the locked configuration. For example, the length of the strap 608 and/or the length/position of the male component 118*b* relative to the strap 608 can be adjusted. Lengthening the strap 608 and/or extending the male component 118*b* relative to the second end portion of the strap 608 would loosen the opening 610 of the article when the clasp 118 is in the locked configuration. Shortening the strap 608 and/or retracting the male component 118*b* relative to the second end portion of the strap 608 would tighten the opening 610 of the article when the clasp 118 is in the locked configuration. As one example, this can be accomplished by adjustably coupling the male component 118*b* to the strap 608 (e.g., with a clamping mechanism or other type of adjustment mechanism).

The tension of the upper 604 can also be adjusted by configuring the clasp with a male component having a plurality of head portions (e.g., similar to the male component 200) and/or with a female component having a plurality of locking elements (e.g., similar to the female component 300).

It should be noted that the article 600 can comprise more than one strap 608 and/or clasp 118. For example, the article 600 can have 2-10 straps and/or 2-10 clasps disposed at various locations on the article 600. In some embodiments, the straps and/or claps can be oriented in the same way (e.g., the straps and/or male components on the medial side portion of the upper and the female components on the lateral side portion of the upper). In other embodiments, the orientation of at least one strap and/or clasp (e.g., the strap and/or male component on the medial side portion of the upper and the female component on the lateral side portion of the upper) can be different that the orientation of at least one other strap and/or clasp (e.g., the straps and/or male components on the lateral side portion of the upper and the female component on the medial side portion of the upper).

In some embodiments, the article 600 can include the clasp 400 or the clasp 500 in lieu of the clasp 118.

Although not shown, it should be noted that the article 600 can include a secondary closure mechanism such as laces. The laces can extend across the tongue from one side of the upper to another.

Figure 18A:
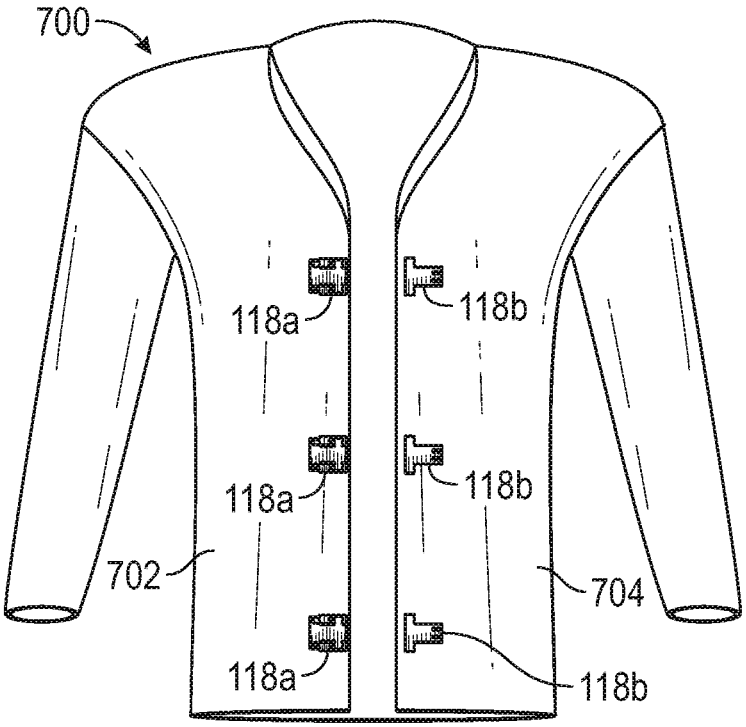
FIG. 18A depicts a perspective view an article of apparel having an exemplary closure mechanism that includes a clasp, which is shown in an unlocked configuration.
Figure 18B:
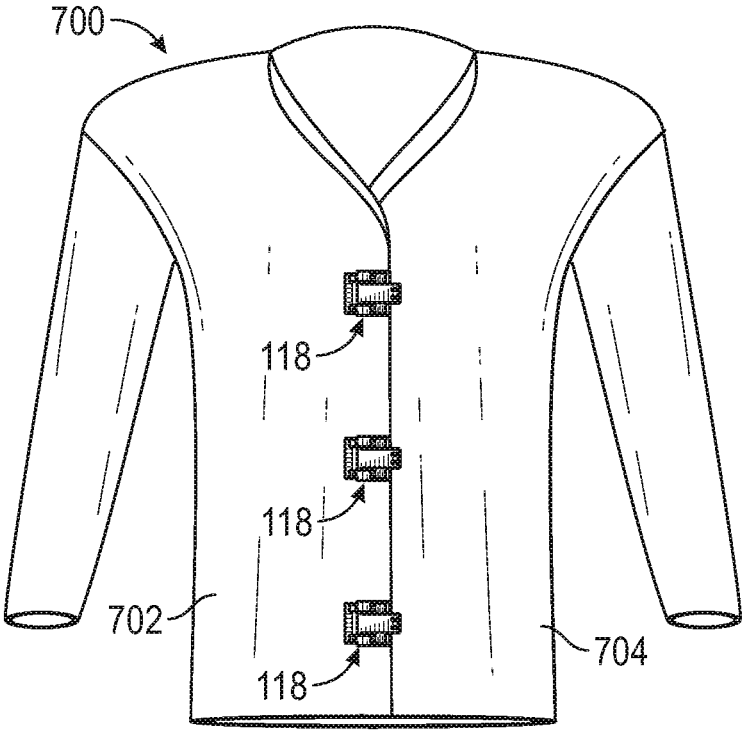
FIG. 18B depicts a perspective view of the article of apparel of FIG. 18A, showing the clasp of the closure mechanism in a locked configuration.

FIGS. 18A-18B show an exemplary article of apparel (e.g., a jacket) 700 comprising a closure mechanism that can be easily opened and closed for adjusting and/or securing an opening of the article. For example, the closure mechanism can be opened and closed with one hand, and/or by a person with low dexterity and/or lacking fine motor skills. In some embodiments, the closure system can have a first component coupled to a right side portion of the article and a second component coupled to a left side portion of the article.

In the illustrated embodiment, the closure mechanism comprises a plurality (e.g., three) of the clasps 118. The female portions 118*a* of the clasps 118 can each be coupled to a right side portion 702 of the article 700, and the male portions 118*b* of the clasps 118 can each be coupled to a left side portion 704 of the article 700, or vice versa. The clasps 118 can be unlocked (e.g., FIG. 18A), which allows the article 700 to open. The clasps 118 can be locked (e.g., FIG. 18B), which secures the article 700 in a closed configuration.

In other embodiments, at least one clasp 118 can be coupled to the article such that female component 118*a* is coupled to the right side portion 702 of the article 700 and the male component 118*b* is coupled to the left side portion of the article, and at least one other clasp 118 can be coupled to the article such that the female portion can be coupled to the left side portion 704 of the article 700 and the male component 118*b* is coupled to the right side portion of the article.

In some embodiments, the clasps can be partially or completely concealed, such as by coupling the male components of the clasps to an interior portion of the article and/or by covering the clasps with a flap or cover.

In some embodiments, the article 700 can include the clasp 400 or the clasp 500 in lieu of the clasp 118. Additionally or alternatively, the article 700 can include a clasp with a male component configured similar to the male component 200 and/or a female component configured similar to the female component 300.

In some embodiments, a male component of the clasp can comprise a gripper that extends outwardly therefrom. The gripper can, for example, provide a location at which a user can push against (e.g., with a finger, thumb, etc.) to move the clasp between the locked and/or unlocked positions. The gripper can comprise various shapes. For example, the gripper can have an arcuate shape in some embodiments. In other embodiments, the gripper can have a ring or partial ring shape. In yet other embodiments, the gripper element can have a rectangular shape.

The structural features described herein, with regard to any example, can be used separately and/or combined with other structural features described in any one or more of the other examples. For example, one or more features of the clasp 100 can be combined with one or more features of the clasp 500, or vice versa. As another example, the article 100 can comprise the strap 608 of the article 600. As yet another example, the tension adjustment features described with respect to the article 600 can be adapted to the article 100 and/or the article 700.

Additional Examples

Additional examples of the disclosed technology are enumerated below. Any feature of the following examples can be combined with a feature of an example described above and/or below.

1. An article of footwear comprises an upper and a closure mechanism. The upper has a first portion, a second portion, and an opening at least partially located between the first portion and the second portion. The opening is adjustable between a first size that provides an open configuration and a second size that provides a closed configuration. The first size is larger than the second size. The closure mechanism is moveable between an unlocked position and a locked position and includes a locking element coupled to the first portion of the upper and a projection coupled to the second portion of the upper. The projection is moveable in a first direction relative to the locking element to engage with the locking element, thereby moving the closure mechanism from the unlocked position to the locked position and moving the upper from the open configuration to the closed configuration. The projection is moveable in the first direction relative to the locking element to disengage with the locking element, thereby moving the closure mechanism from the locked position to the unlocked position and allowing the upper to return to the open configuration.

2. The article of footwear of example 1, wherein the projection moves in a single plane as the projection moves in the first direction relative to the locking element from the unlocked position to the locked position and from the locked position to the unlocked position.

3. The article of footwear of example 1 or example 2, wherein the locking element comprises a plurality of first tabs, and wherein when the closure mechanism is in the locked position, the first tabs engage with the projection to restrict movement of the projection in a second direction relative to the locking element.

4. The article of footwear of example 3, wherein the first tabs of the locking element are movable between an un-deflected state and a deflected state, wherein the first tabs are in the un-deflected state when the closure mechanism is in the locked position, and wherein the first tabs are at least temporarily in the deflected state as the closure mechanism moves from the unlocked position to the locked position.

5. The article of footwear of example 4, wherein in the deflected state, at least a portion of the first tabs are disposed relatively closer to the first portion of the upper than when the first tabs are in the un-deflected state.

6. The article of footwear of any one of examples 2-5, wherein the locking element comprises a plurality of second tabs, and wherein when the closure mechanism is in the locked position, the second tabs engage with the projection to restrict movement of the projection in the first direction relative to the locking element.

7. The article of footwear of example 6, wherein the second tabs of the locking element are movable between an un-deflected state and a deflected state, wherein the second tabs are in the un-deflected state when the closure mechanism is in the locked position, and wherein the second tabs are at least temporarily in the deflected state as the closure mechanism moves from the locked position to the unlocked position.

8. The article of footwear of example 7, wherein in the deflected state, at least a portion of the second tabs are disposed relatively farther from the first portion of the upper than when the second tabs are in the un-deflected state.

9. The article of footwear of any one of examples 6-8, wherein the closure mechanism further comprises a main platform, and the locking element further comprises a plurality of flanges spaced apart from the main platform, wherein the second tabs of the locking element extend at an angle from the flanges to the main platform, wherein the unlocked position of the closure mechanism is a second unlocked position, and the closure mechanism is movable from a first unlocked position to the locked position and from the locked position to the second unlocked position, and wherein the closure mechanism is configured such that the projection passes from a second position on the main platform, to the second tabs, to flanges, and to a first position on the main platform as the closure mechanism is moved from the second unlocked position to the first unlocked position.

10. The article of footwear of any one of examples 1-9, wherein the locking element is configured such that the closure mechanism can be moved from the unlocked position to the locked position and from the locked position to the unlocked position without the use of fingers.

11. The article of footwear of any one of examples 1-10, wherein the locking element is configured such that the closure mechanism can be moved from the unlocked position to the locked position and from the locked position to the unlocked position with a foot of a wearer.

12. The article of footwear of any one of examples 1-11, wherein the closure mechanism is a first closure mechanism coupled to a lateral side portion of the upper, and the article of footwear further comprises a second closure mechanism coupled to a medial side portion of the upper.

13. The article of footwear of any one of examples 1-12, wherein the first portion of the upper is a lateral side portion of the upper, and wherein the second portion of the upper is a medial side portion of the upper.

14. The article of footwear of any one of examples 1-12, further comprising a strap, wherein the first portion of the upper is a lateral side portion of the upper, wherein the second portion of the upper is a medial side portion of the upper, and wherein the strap is coupled to the medial side portion of the upper, and the projection of the closure mechanism is coupled to the strap.

15. The article of footwear of any one of examples 1-12, wherein the first portion of the upper is a toe and midfoot portion of the upper, and wherein the second portion of the upper is a heel portion of the upper.

16. The article of footwear of any one of examples 1-15, further comprising a lace or a strap extending coupled to the first or second portion of the upper.

17. The article of footwear of any one of examples 1-16, further comprising a sole structure, wherein the first portion of the upper is fixedly secured relative to the sole structure, and wherein the second portion of the upper is movably coupled to the sole structure.

18. The article of footwear of any one of examples 1-17, further comprising a first sole structure and a second sole structure, wherein the first portion of the upper is coupled to the first sole structure, and the second portion of the upper is coupled to the second sole structure, and wherein the first sole structure can be separated from the second sole structure when the closure mechanism is in the unlocked position, and the first sole structure cannot be separated from the second sole structure when the closure mechanism is in the locked position.

19. The article of footwear of any one of examples 1-18, wherein the projection of the closure mechanism comprises a stem portion and first and second head portions extending from the stem portion, wherein the first head portion or the second head portion engages the locking element in the locked position, and wherein the first head portion and the second head portion disengage the locking element in the unlocked position.

20. An article of footwear comprises an upper and a closure mechanism. The upper has a first portion, a second portion, and an opening at least partially located between the first portion and the second portion. The opening is adjustable between a first size that provides an open configuration, a second size that provides a first closed configuration, and a third size that provides a second closed configuration. The first size is larger than the second size and the third size, and the second size is larger than the third size. The closure mechanism is moveable between a plurality of unlocked positions and a plurality of locked positions. The closure mechanism including a first component coupled to the first portion of the upper and a second component coupled to the second portion of the upper. The first component comprises a first locking element and a second locking element. The second component comprises a projection. The projection is moveable in a first direction relative to the first locking element to engage with the first locking element, thereby moving the closure mechanism from a first unlocked position to a first locked position and moving the upper from the open configuration to the first closed configuration. The projection is moveable in the first direction relative to the first locking element to disengage with the first locking element, thereby moving the closure mechanism from the first locked position to a second unlocked position and allowing the upper to return to the open configuration. The projection is moveable in a first direction relative to the second locking element to engage with the second locking element, thereby moving the closure mechanism from the second unlocked position to a second locked position and moving the upper from the open configuration to the second closed configuration. The projection is moveable in the first direction relative to the second locking element to disengage with the second locking element, thereby moving the closure mechanism from the second locked position to a third unlocked position and allowing the upper to return to the open configuration.

21. The article of footwear of example 20, wherein the projection of the first component is a first head portion, and the first component further comprises a second head portion spaced apart longitudinally from the first head portion, wherein the first or second head portion engages the first or second locking element in the first and second locked positions, and wherein the first and second head portions disengage the first and second locking elements in the first, second, and third unlocked positions.

22. An article of apparel or footwear comprises a closure mechanism with a female component and a male component and configured for adjusting an opening of the article. The female component is coupled to a first portion of the article. The male component is coupled to a second portion of the article. The female component comprises a slot for receiving the male component. The female component comprises a locking element configured to retain the male component within the slot when the male component is in a locked position and to allow relative movement between the female component and the male component when the male component is in an unlocked position. The male component is movable from the unlocked position to the locked position by moving the male component in a first direction relative to the female component. The male component is movable from the locked position to the unlocked position by moving the male component farther in the first direction relative to the female component.

23. The article of example 22, wherein the article is a running shoe, soccer shoe, football shoe, rugby shoe, basketball shoe, baseball shoe, sneaker, hiking boot, or sandal.

24. The article of example 22, wherein the article is a bag, hat, glove, jacket, vest, shorts, or pants.

25. An article of apparel or footwear comprises a closure mechanism with a clasp. The clasp includes a female component and a male component that can be inserted into the female component. The clasp is movable between an unlocked configuration and a locked configuration. The female component of the clasp comprises a first wall, a second wall, a third wall, a curved ramp, a plurality of tabs, a plurality of flanges, and a fulcrum. The second and third walls are coupled to and extend perpendicular from the first wall. The ramp extends from a first end portion of the first wall. The tabs are coupled to and extend at an angle from the first wall. The tabs are movable between first and second positions. The tabs are biased toward the first position. Each of the flanges is coupled to the second or third wall and spaced apart from the tabs when the tabs are in the second position. The fulcrum is coupled to and extends from the first wall at a location spaced apart from the ramp and the tabs. The male component comprises a head portion and a stem portion extending from the head portion. The stem portion is pivotably coupled to the fulcrum of the female component. In the unlocked configuration, the head portion of the male component is disposed on a first side of the tabs of the female component and can be moved in a first direction of a first plane relative to the tabs. In the locked configuration, the head portion of the male component is disposed on a second side of the tabs of the female component, and the tabs of the female component prevent the head portion of the male component from moving in a second direction of the first plane relative to the tabs from the second side of the tabs to the first side of the tabs. The ramp of the female component is configured to guide the head portion of the male component from the first plane to a second plane in which the head portion is movable in the second direction relative to the tabs. The stem portion of the male component is configured to pivot about the fulcrum of the female component when the head portion of the male component moves between the first and second planes.

26. The article of example 25, wherein the article is a running shoe, soccer shoe, football shoe, rugby shoe, basketball shoe, baseball shoe, sneaker, hiking boot, or sandal.

27. The article of example 25, wherein the article is a bag, hat, glove, jacket, vest, shorts, or pants.

28. The article of any one of examples 25-27, wherein the head portion of the male component comprises a cylindrical shape.

29. A method of actuating a closure mechanism for an article of footwear or apparel between an unlocked configuration and a locked configuration, is provided. The method comprises inserting a male component of the closure mechanism into a female component of the closure mechanism, moving the male component in a first direction and in a first plane relative to the female component from the unlocked configuration to a locked configuration, and moving the male component in the first direction and in the first plane relative to the female component from the locked configuration to the unlocked configuration.

30. The method of example 29, wherein the unlocked configuration includes an initial unlocked configuration and a final unlocked configuration, and wherein the method further comprises moving the male component in a second direction over a ramp from the final unlocked configuration to the initial unlocked configuration.

31. The method of example 29, further comprising pivoting the male component on a fulcrum of the female component such that the male component moves relative to the female component from the first plane to a second plane.

32. The method of example 31, further comprising moving the male component in a second direction and in the second plane relative to the female component from the locked configuration to the unlocked configuration.

33. The method of any one of examples 29-32, wherein the acts of moving and advancing the male component are performed without the use of fingers.

34. The method of any one of examples 29-33, wherein the acts of moving and advancing the male component are performed using a foot.

In view of the many possible embodiments to which the principles of the disclosure may be applied, it should be recognized that the illustrated embodiments are only examples and should not be taken as limiting the scope of the claims. Rather, the scope of the claimed subject matter is defined by the following claims and their equivalents.

The invention claimed is:

1. An article of footwear comprising:

an upper having a first portion, a second portion, and an opening at least partially located between the first portion and the second portion, the opening being adjustable between a first size that provides an open configuration and a second size that provides a closed configuration, the first size being larger than the second size; and a closure mechanism moveable between an unlocked position and a locked position, the closure mechanism including a male component and a female component, wherein the male component comprises a non-deflecting projection coupled to the second portion of the upper, and wherein the female component is coupled to the first portion of the upper and comprises a locking element having one or more deflecting components configured for selectively engaging the non-deflecting projection of the male component as the closure mechanism moves between the unlocked position and the locked position, wherein the non-deflecting projection of the male component is moveable in a first direction from a first position to a second position relative to the locking element of the female component, thereby deflecting the one or more deflecting components of the female component with the non-deflecting projection of the male component, moving the closure mechanism from the unlocked position to the locked position and moving the upper from the open configuration to the closed configuration, wherein when the male component is in the second position the male component is disposed within the female component, and wherein the non-deflecting projection of the male component is further moveable in the first direction from the second position to a third position relative to the locking element of the female component to disengage with the one or more deflecting components of the locking element, thereby moving the closure mechanism from the locked position to the unlocked position and allowing the upper to return to the open configuration.

2. The article of footwear of claim 1, wherein the non-deflecting projection moves in a single plane as the non-deflecting projection moves in the first direction relative to the locking element from the unlocked position to the locked position and from the locked position to the unlocked position.

3. The article of footwear of claim 1, wherein the one or more deflecting components comprise a plurality of first tabs, and wherein when the closure mechanism is in the locked position, the first tabs engage with the non-deflecting projection to restrict movement of the projection in a second direction relative to the locking element.

4. The article of footwear of claim 3, wherein the first tabs of the locking element are movable between an un-deflected state and a deflected state, wherein the first tabs are in the un-deflected state when the closure mechanism is in the locked position, and wherein the first tabs are at least temporarily in the deflected state as the closure mechanism moves from the unlocked position to the locked position.

5. The article of footwear of claim 4, wherein in the deflected state, at least a portion of the first tabs are disposed relatively closer to the first portion of the upper than when the first tabs are in the un-deflected state.

6. The article of footwear of claim 3, wherein the one or more deflecting components further comprise a plurality of second tabs, and wherein when the closure mechanism is in the locked position, the second tabs engage with the projection to restrict movement of the projection in the first direction relative to the locking element.

7. The article of footwear of claim 6, wherein the second tabs of the locking element are movable between an un-deflected state and a deflected state, wherein the second tabs are in the un-deflected state when the closure mechanism is in the locked position, and wherein the second tabs are at least temporarily in the deflected state as the closure mechanism moves from the locked position to the unlocked position.

8. The article of footwear of claim 7, wherein in the deflected state, at least a portion of the second tabs are disposed relatively farther from the first portion of the upper than when the second tabs are in the un-deflected state.

9. The article of footwear of claim 6, wherein the closure mechanism further comprises a main platform, and the locking element further comprises a plurality of flanges spaced apart from the main platform, wherein the second tabs of the locking element extend at an angle from the flanges to the main platform, wherein the unlocked position of the closure mechanism is a second unlocked position, and the closure mechanism is movable from a first unlocked position to the locked position and from the locked position to the second unlocked position, and wherein the closure mechanism is configured such that the non-deflecting projection passes from a second position on the main platform, to the second tabs, to the flanges, and to a first position on the main platform as the closure mechanism is moved from the second unlocked position to the first unlocked position.

10. The article of footwear of claim 1, wherein the locking element is configured such that the closure mechanism can be moved from the unlocked position to the locked position and from the locked position to the unlocked position without the use of fingers.

11. The article of footwear of claim 1, wherein the locking element is configured such that the closure mechanism can be moved from the unlocked position to the locked position and from the locked position to the unlocked position with a foot of a wearer.

12. The article of footwear of claim 1, wherein the closure mechanism is a first closure mechanism coupled to a lateral side portion of the upper, and the article of footwear further comprises a second closure mechanism coupled to a medial side portion of the upper.

13. The article of footwear of claim 1, wherein the first portion of the upper is a lateral side portion of the upper, and wherein the second portion of the upper is a medial side portion of the upper.

14. The article of footwear of claim 1, wherein the first portion of the upper is a toe and midfoot portion of the upper, and wherein the second portion of the upper is a heel portion of the upper.

15. The article of footwear of claim 1, further comprising a lace or a strap coupled to the first or second portion of the upper.

16. The article of footwear of claim 1, further comprising a sole structure, wherein the first portion of the upper is fixedly secured relative to the sole structure, and wherein the second portion of the upper is movably coupled to the sole structure.

17. The article of footwear of claim 1, further comprising a first sole structure and a second sole structure, wherein the first portion of the upper is coupled to the first sole structure, and the second portion of the upper is coupled to the second sole structure, and wherein the first sole structure can be separated from the second sole structure when the closure mechanism is in the unlocked position, and the first sole structure cannot be separated from the second sole structure when the closure mechanism is in the locked position.

18. The article of footwear of claim 1, wherein the projection of the closure mechanism comprises a stem portion and first and second head portions extending from the stem portion, wherein the first head portion or the second head portion engages the locking element in the locked position, and wherein the first head portion and the second head portion disengage the locking element in the unlocked position.

19. An article of footwear comprising:

an upper having a first portion, a second portion, and an opening at least partially located between the first portion and the second portion, the opening being adjustable between a first size that provides an open configuration and a second size that provides a closed configuration, the first size being larger than the second size; and a closure mechanism moveable between an unlocked position and a locked position, the closure mechanism including a locking element coupled to the first portion of the upper and a projection coupled to the second portion of the upper, wherein the projection is moveable in a first direction relative to the locking element to engage with the locking element, thereby moving the closure mechanism from the unlocked position to the locked position and moving the upper from the open configuration to the closed configuration, wherein the projection is moveable in the first direction relative to the locking element to disengage with the locking element, thereby moving the closure mechanism from the locked position to the unlocked position and allowing the upper to return to the open configuration, wherein the locking element comprises a plurality of first tabs, and wherein when the closure mechanism is in the locked position, the first tabs engage with the projection to restrict movement of the projection in a second direction relative to the locking element, and wherein the first tabs of the locking element are movable between an un-deflected state and a deflected state, wherein the first tabs are in the un-deflected state when the closure mechanism is in the locked position, and wherein the first tabs are at least temporarily in the deflected state as the closure mechanism moves from the unlocked position to the locked position.

20. An article of footwear comprising:

an upper having a first portion, a second portion, and an opening at least partially located between the first portion and the second portion, the opening being adjustable between a first size that provides an open configuration and a second size that provides a closed configuration, the first size being larger than the second size; and a closure mechanism moveable between an unlocked position and a locked position, the closure mechanism including a locking element coupled to the first portion of the upper and a projection coupled to the second portion of the upper, wherein the projection is moveable in a first direction relative to the locking element to engage with the locking element, thereby moving the closure mechanism from the unlocked position to the locked position and moving the upper from the open configuration to the closed configuration, wherein the projection is moveable in the first direction relative to the locking element to disengage with the locking element, thereby moving the closure mechanism from the locked position to the unlocked position and allowing the upper to return to the open configuration, wherein the locking element comprises a plurality of first tabs, and wherein when the closure mechanism is in the locked position, the first tabs engage with the projection to restrict movement of the projection in a second direction relative to the locking element, and wherein the locking element comprises a plurality of second tabs, and wherein when the closure mechanism is in the locked position, the second tabs engage with the projection to restrict movement of the projection in the first direction relative to the locking element.

* * * * *